US009725236B2

(12) United States Patent
Starck et al.

(10) Patent No.: US 9,725,236 B2
(45) Date of Patent: Aug. 8, 2017

(54) TANK ASSEMBLY WITH LINER

(71) Applicant: World Shipping, Inc., Rocky River, OH (US)

(72) Inventors: Thomas J. Starck, Avon Lake, OH (US); Waldemar Frans Finke, Rotterdam (NL)

(73) Assignee: Tankbag Properties LLC, Rocky River, OH (US)

( * ) Notice: Subject to any disclaimer, the term of this patent is extended or adjusted under 35 U.S.C. 154(b) by 462 days.

(21) Appl. No.: 14/213,039

(22) Filed: Mar. 14, 2014

(65) Prior Publication Data

US 2014/0263361 A1 Sep. 18, 2014

Related U.S. Application Data

(60) Provisional application No. 61/792,915, filed on Mar. 15, 2013.

(51) Int. Cl.
*B65D 90/04* (2006.01)
*B65D 88/12* (2006.01)
(Continued)

(52) U.S. Cl.
CPC ..... *B65D 90/046* (2013.01); *B65D 88/128* (2013.01); *B65D 88/62* (2013.01); *B65D 90/00* (2013.01); *B65D 90/10* (2013.01); *B65D 2590/046* (2013.01); *Y10T 29/49826* (2015.01); *Y10T 29/53* (2015.01)

(58) Field of Classification Search
CPC .... B65D 90/046; B65D 88/128; B65D 90/00; B65D 88/62; B65D 90/10; Y10T 29/53
USPC ..... 141/2, 10, 313; 220/212; 224/901, 913; 206/373
See application file for complete search history.

(56) References Cited

U.S. PATENT DOCUMENTS 2,572,706 A * 10/1951 Eichholz ..... B65D 25/02 190/18 R
3,261,521 A * 7/1966 Meccico ..... B60R 7/14 211/64
(Continued)

FOREIGN PATENT DOCUMENTS

DE 44 28 284 A1 2/1996
EP 1 767 468 A1 3/2007
(Continued)

*Primary Examiner* — Allana Lewin Bidder
*Assistant Examiner* — James Hakomaki
(74) *Attorney, Agent, or Firm* — Tarolli, Sundheim, Covell & Tummino LLP

(57) ABSTRACT

A tank assembly for receiving liquids comprises a tank body. The tank body includes a tank wall defining an enclosed tank cavity. The tank body also includes a manhole lid attached to the tank wall and movable from a closed position covering a manhole in the tank body to an open position uncovering the manhole. A liner includes a flexible liner wall defining an enclosed liner cavity. An opening is formed in the liner wall to permit liquid to be introduced into the liner cavity. The liner also includes a fitting secured to the liner wall at the opening in the liner wall. A first end of a hose is attached to the fitting for conducting fluid to the liner cavity. A valve is attached to a second end of the hose. The valve and the second end of the hose are releasably attached to the manhole lid.

17 Claims, 16 Drawing Sheets

(51) Int. Cl.

| | |
|---|---|
| ***B65D 88/62*** | (2006.01) |
| ***B65D 90/00*** | (2006.01) |
| ***B65D 90/10*** | (2006.01) |

(56) References Cited

U.S. PATENT DOCUMENTS

| | | | | | |
|---|---|---|---|---|---|
| 3,384,106 | A | | 5/1968 | Isbrandtsen | |
| 3,461,584 | A | * | 8/1969 | Wilson | G09F 21/04 40/591 |
| 4,205,315 | A | * | 5/1980 | Fleenor | G01F 23/284 342/124 |
| 4,241,833 | A | * | 12/1980 | Luebcke | A61F 17/00 206/373 |
| 4,387,873 | A | * | 6/1983 | Pavlo | A61M 5/1415 211/113 |
| 4,995,537 | A | * | 2/1991 | Thedieck | B60R 7/14 211/64 |
| 5,007,605 | A | * | 4/1991 | Horvath | F16L 3/1226 248/62 |
| 5,115,943 | A | | 5/1992 | Coleman | |
| D342,012 | S | * | 12/1993 | Doyle | D8/356 |
| 5,310,103 | A | * | 5/1994 | Weber | B60R 11/06 224/311 |
| 5,368,395 | A | * | 11/1994 | Crimmins | B65D 88/1656 383/107 |
| D371,107 | S | * | 6/1996 | Summers | D12/406 |
| 5,544,797 | A | * | 8/1996 | Silva | B60R 7/08 211/70.8 |
| 6,286,700 | B1 | * | 9/2001 | Davidson | B65D 77/065 220/1.6 |
| 7,055,440 | B2 | * | 6/2006 | Sisk | B65D 90/10 105/286 |
| 7,086,429 | B2 | | 8/2006 | Moizumi | |
| 7,364,040 | B1 | * | 4/2008 | Hunter | B25H 3/06 206/349 |
| 7,424,767 | B2 | * | 9/2008 | Giles | E01H 1/0854 15/331 |
| 7,849,568 | B2 | * | 12/2010 | Wilkinson | B65H 75/366 24/298 |
| 8,132,686 | B2 | * | 3/2012 | Buonerba | B60P 3/426 220/1.6 |
| D687,247 | S | * | 8/2013 | Meeks | D6/552 |
| 2007/0023438 | A1 | | 2/2007 | Kenneth, Jr. | |
| 2007/0071590 | A1 | | 3/2007 | Podd | |
| 2007/0193649 | A1 | | 8/2007 | Podd | |
| 2010/0032053 | A1 | | 2/2010 | Chong et al. | |
| 2011/0139788 | A1 | * | 6/2011 | Li | B65D 90/046 220/495.05 |
| 2012/0087760 | A1 | | 4/2012 | Sims | |

FOREIGN PATENT DOCUMENTS

| | | | |
|---|---|---|---|
| EP | 1 820 750 | A2 | 8/2009 |
| JP | 2010 235205 | A | 10/2010 |
| WO | 2008102312 | | 8/2008 |
| WO | WO 2010/120183 | * | 10/2010 |

* cited by examiner

TANK ASSEMBLY WITH LINER

RELATED APPLICATION

This application claims the benefit of U.S. Provisional Application Ser. No. 61/792,915, which was filed on Mar. 15, 2013.

FIELD OF THE INVENTION

The present invention relates to a tank assembly that comprises a tank body and a liner for the tank body and to a method of installing a tank liner in a tank body and, more particularly, to a tank assembly in which a hose and a valve connected to a flexible tank liner are releasably attached to a manhole lid on a tank body and to a method of installing such a tank liner in a tank body.

BACKGROUND OF THE INVENTION

One method of transporting liquids, such as liquid chemicals or liquids for human consumption, is to load the liquids into a shipping container, such as a cylindrical tank mounted in a rectangular frame. When filled, such a shipping tank or tank container can be transported by truck to a port and then loaded on, for example, a container ship for transoceanic transport to another port. The tank container is unloaded from the container ship at the destination port and is emptied of its liquid cargo. The tank container may then be re-used for transporting another liquid cargo, provided such a cargo is available and provided the tank container is in a condition for receiving another cargo. Having a tank container in a condition for receiving another cargo typically involves cleaning the tank at a cleaning station specifically designed for such a purpose. Cleaning a tank container is a relatively expensive process. To avoid or minimize such cleaning, a flexible liner may be installed in the tank.

SUMMARY OF THE INVENTION

The present invention is directed to a tank assembly that comprises a tank body and a liner for the tank body and to a method of installing a tank liner in a tank body and, more particularly, to a tank assembly in which a hose and a valve connected to a flexible tank liner are releasably attached to a manhole lid on a tank body and to a method of installing such a tank liner in a tank body.

In accordance with an embodiment of the present invention, a tank assembly for receiving liquids comprises a tank body. The tank body includes a tank wall defining an enclosed tank cavity. A manhole is formed in the tank wall to permit a person to enter the tank cavity. The tank body also includes a manhole lid attached to the tank wall. The manhole lid is movable from closed position covering the manhole to an open position uncovering the manhole. A liner in the tank cavity includes a flexible liner wall defining an enclosed liner cavity. An opening is formed in the liner wall to permit liquid to be introduced into the liner cavity. The liner also includes a fitting extending through the opening. The fitting is secured to the liner wall adjacent the opening. A hose has a first end and a second end. The first end of the hose is attached to the fitting for conducting fluid to the liner cavity. A valve is attached to the second end of the hose. The valve and the second end of the hose are attachable to the manhole lid such that the valve and the second end of the hose remain attached to the manhole lid when the manhole lid is in its closed position. The valve and the second end of the hose are releasable from the manhole lid when the manhole lid is in its open position In accordance with another embodiment of the present invention, a tank assembly for receiving liquids comprises a tank body. The tank body includes a tank wall defining an enclosed tank cavity. A manhole is formed in the tank wall to permit a person to enter the tank cavity. The tank body also includes a manhole lid attached to the tank wall. The manhole lid is movable from closed position covering the manhole to an open position uncovering the manhole. A liner in the tank cavity includes a flexible liner wall defining an enclosed liner cavity. An opening is formed in the liner wall to permit liquid to be introduced into the liner cavity. The liner also includes a strap connected to the liner wall at a location spaced from the opening. An end portion of the strap spaced from the liner wall is attachable to the manhole lid such that the end portion of the strap valve remains attached to the manhole lid when the manhole lid is in its closed position. The end portion of the strap when attached to the manhole lid moves with the manhole lid as the manhole lid moves from the closed position to the open position. The end portion of the strap is releasable from the manhole lid when the manhole lid is in its open position.

In accordance with yet another embodiment of the present invention, a liner for a tank comprises a flexible liner wall defining an enclosed liner cavity. An opening is formed in the liner wall to permit liquid to be introduced into and discharged from the liner cavity. A strap is connected to the liner wall at a location spaced from the opening. A portion of the liner wall is movable in response to application of a pulling load on the strap so as to increase a flow of liquid in the liner toward the opening.

In accordance with still another embodiment of the present invention, an apparatus is provided for attaching a hose and a valve to a manhole lid on a tank assembly for receiving liquids. The manhole lid is movable from closed position covering the manhole to an open position uncovering the manhole. The apparatus comprises a body formed of flexible material. The body includes a portion for engaging the manhole lid adjacent an outer perimeter of the manhole lid. The body is attached to the manhole lid when the portion engages the manhole lid. The apparatus also comprises attachment structure for coupling at least one of the hose and the valve to the body of flexible material such that the at least one of the hose and the valve remains attached to the manhole lid when the manhole lid is in its closed position. The at least one of the hose and the valve is releasable from the manhole lid when the manhole lid is in its open position.

In accordance with a further embodiment of the present invention, a method is provided for installing a flexible liner in a tank for receiving liquids. The tank includes a tank body with a tank wall defining an enclosed tank cavity. A manhole is formed in the tank wall to permit a person to enter the tank cavity. The tank body also includes a manhole lid attached to the tank wall. The manhole lid is movable from closed position covering the manhole to an open position uncovering the manhole. The liner includes a flexible liner wall defining an enclosed liner cavity. An opening is formed in the liner wall to permit liquid to be introduced into the liner cavity. The method comprises the step of spreading out the liner so that opposite surfaces of the liner wall are touching each other and the liner is flattened with a generally rectangular shape. The generally rectangular shape of the flattened liner includes a first side and an opposed second side and a first end and an opposed second end. The opening in the liner is positioned centrally between the first and second sides and spaced longitudinally away from the first and second ends. The method also comprises the steps of folding the first side of the flattened liner toward the center of the liner while leaving the opening exposed and folding the second side of the flattened liner toward the center of the liner while leaving the opening exposed. The method further comprises the step of folding the first end of the flattened liner toward the opening after folding the first and second sides of the flattened liner toward the center of the liner. The opening is left exposed after folding the first end of the flattened liner toward the opening. The method still further comprises the step of folding the second end of the flattened liner toward the opening after folding the first and second sides of the flattened liner toward the center of the liner. The method yet further comprises the step of placing the liner in the tank cavity after folding the first and second sides of the flattened liner toward the center of the liner and after folding the first and second ends of the flattened liner toward the opening. The opening is presented toward the manhole when the liner is placed in the tank cavity. The method comprises further the steps of unfolding the first and second ends of the liner after placing the liner in the tank cavity and partially unfolding the first and second sides of the liner after unfolding the first and second ends of the liner. The method comprises still further the step of introducing liquid into the liner cavity through the opening to finish unfolding of the first and second sides of the liner.

In accordance with yet a further embodiment of the present invention, a method is provided for installing a flexible liner in a tank for receiving liquids. The tank includes a tank body with a tank wall defining an enclosed tank cavity. A manhole is formed in the tank wall to permit a person to enter the tank cavity. The tank body also includes a manhole lid attached to the tank wall. The manhole lid is movable from closed position covering the manhole to an open position uncovering the manhole. The liner includes a flexible liner wall defining an enclosed liner cavity. An opening is formed in the liner wall to permit liquid to be introduced into the liner cavity. The method comprises the step of placing the liner in the tank cavity. The opening is presented toward the manhole when the liner is placed in the tank cavity. The method also comprises the step of connecting a hose to the liner so that liquid can be introduced into the liner cavity through the hose and the opening in the liner. The hose has a first end and a second end. The first end of the hose is attached to the liner. The method further comprises the steps of connecting a valve to the second end of the hose and attaching the valve and the second end of the hose to the manhole lid such that the valve and the second end of the hose remain attached to the manhole lid when the manhole lid is in its closed position. The valve and the second end of the hose are releasable from the manhole lid when the manhole lid is in its open position.

BRIEF DESCRIPTION OF THE DRAWINGS

The foregoing and other features and advantages of the present invention will become apparent to one skilled in the art upon consideration of the following description of the invention and the accompanying drawings, in which.

DETAILED DESCRIPTION

Figure 1:
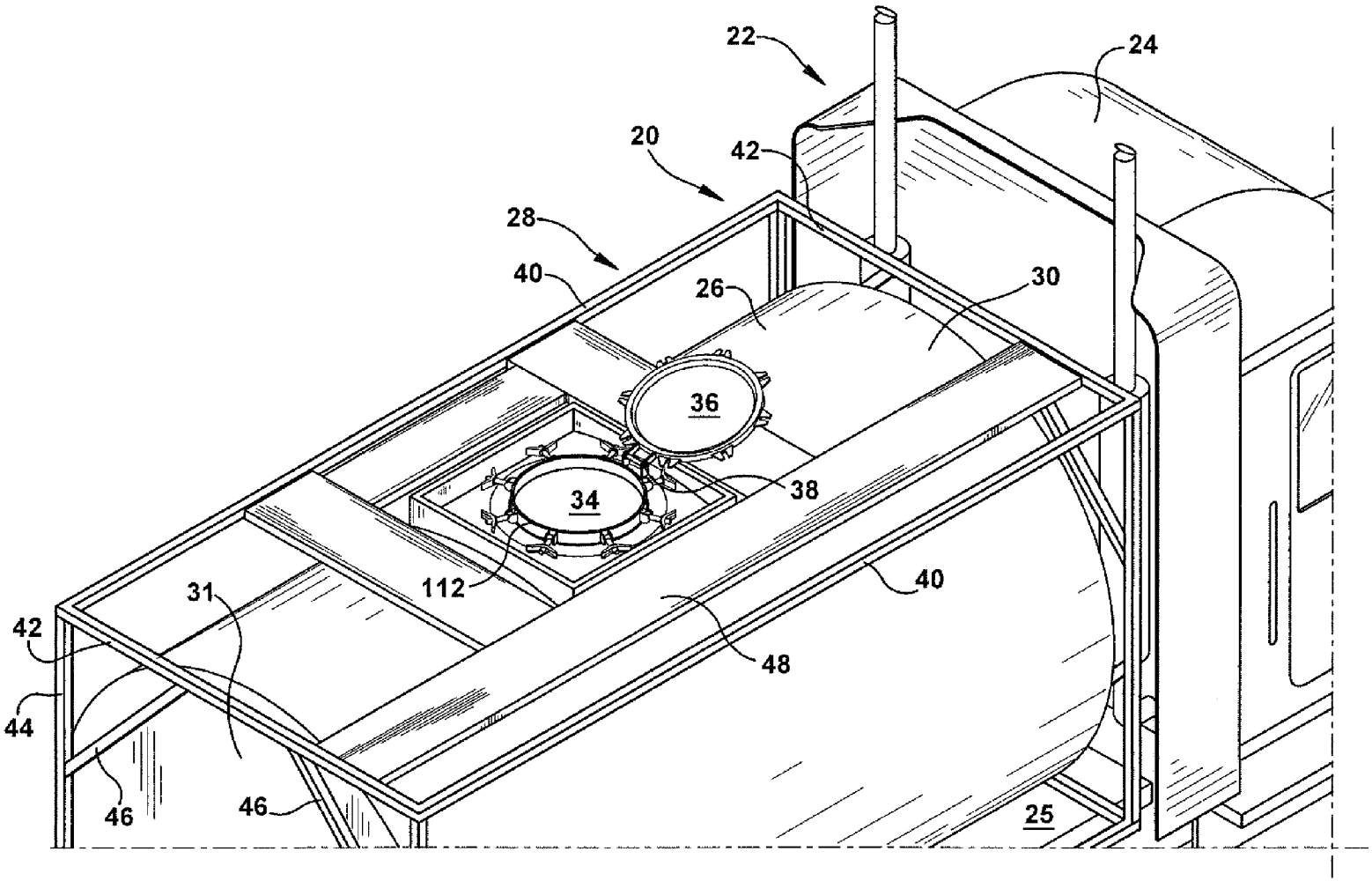
FIG. 1 is a perspective view of a portion of a shipping tank in which a liner can be installed, in accordance with an embodiment of the present invention.
Figure 6:
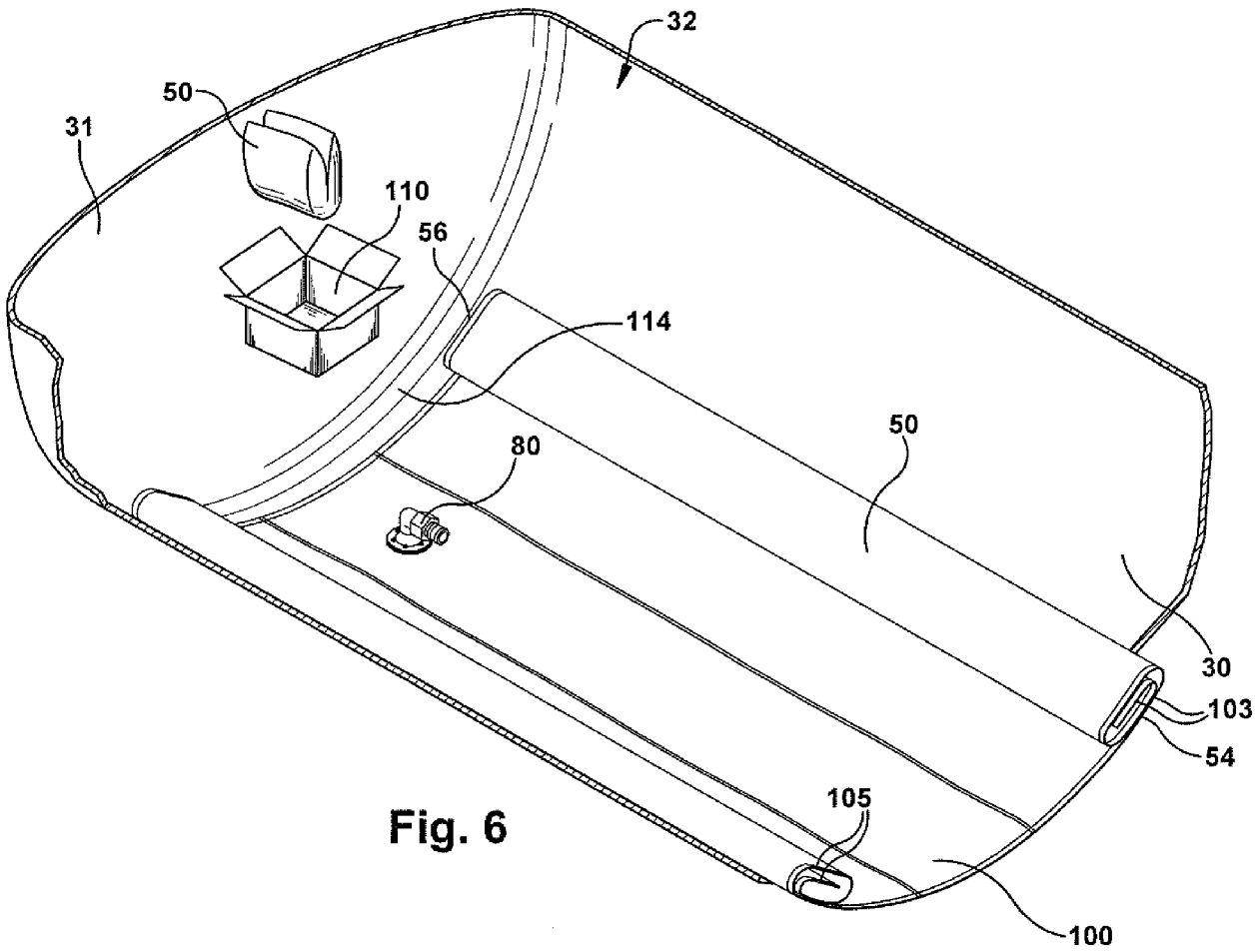
FIG. 6 is view of the interior of the shipping tank of FIG. 1 with the folded liner of FIG. 2 being placed in the shipping tank.

FIG. 1 illustrates a shipping tank or tank container 20 loaded on a truck 22 that includes a prime mover 24 and a semi-trailer 25. The tank container 20 includes a tank body or tank 26 and a supporting frame 28. The tank 26 has a cylindrical side wall 30 with opposite ends that are closed by circular end walls 31, which may be domed, one of which is shown in FIG. 1. The side wall 30 and end walls 31 define an enclosed tank cavity 32 (FIG. 6). A manhole 34 is formed in the side wail 30 of the tank 26 to provide access to the tank cavity 32 for a person (not shown). The manhole 34 may be closed or covered by a manhole lid 36 that is pivotally mounted on the tank 26 by a hinge 38. The side wall 30 and the end walls 31 of the tank 26 are formed of stainless steel or another material that is structurally strong and substantially rigid.

The supporting frame 28, as shown, includes longitudinally extending members 40, laterally extending members 42, vertically extending members 44, and cross-braces 46. The longitudinally extending members 40 and the laterally extending members 42 are joined at their ends to form two rectangular structures disposed above and below the tank 26, as viewed in. FIG. 1. The two rectangular structures are joined to each other by four vertically extending members 44. The cross-braces 46 join the laterally extending members 42 to the vertically extending members 44 at points approximately one-third of the distance from the ends of each member. The supporting frame 28 may be secured to the tank 26 at any location on the supporting frame and on the tank, either by a direct connection or through an intervening structural member. The tank 26 is oriented within the frame 28 such that the manhole 34 is presented upward, as viewed in FIG. 1. A catwalk 48 is secured to the frame 28 adjacent the manhole 34 to facilitate access to the manhole. The frame members 40, 42, and 44 and the cross-braces 46 are formed of steel or another material that is structurally strong and substantially rigid. Although one particular configuration of a frame 28 is shown in FIG. 1, other configurations may be used, consistent with applicable national and international standards. The frame 28 provides a strong and stable structure for lifting, moving, and stacking tanks, such as tank 26.

To facilitate multiple uses of the tank 26, while minimizing the need for cleaning the tank between uses, a flexible liner 50 (FIG. 2) is installed in the tank. The liner 50 is fabricated from flexible polymer sheet material, which may be from about 7 mils to about 9 mils in thickness. The polymer sheet material may be formed of multiple layers of different polymers, such as linear low-density polyethylene (LLDPE) and ethylene vinyl alcohol (EVOH), bonded together. The liner 50 has a side wall 52 that extends for the length of the liner. The side wall 52 is formed as a tube or loop, like a right circular cylinder. The side wall 52 has a first end 54 and a second end 56 that are spaced apart by the length of the side wall, which is also the length of the liner 50. The first and second ends 54 and 56 of the side wall 52 are also the first and second ends of the liner 50.

Figure 10:
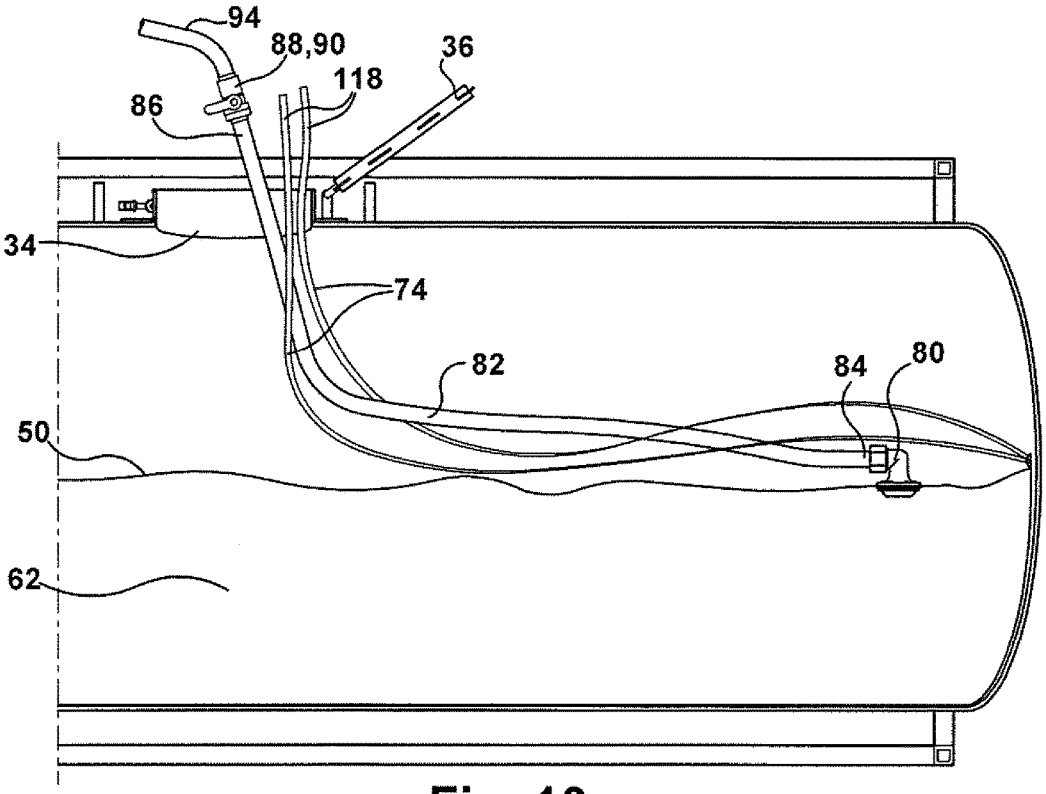
FIG. 10 is a schematic side view of a portion of the shipping container of FIG. 1 with the liner of FIG. 2 partially filled with liquid cargo.

To form the liner 50, the side wall 52 is flattened so that it has a rectangular shape, in plan view, with two portions of the side wall lying on top of one another to provide an upper layer and a lower layer of polymer sheet material. The upper and lower layers of polymer sheet material adjacent to the first end 54 of the side wall 52 are joined to one another by a primary seam 58 that extends entirely across the width of the flattened side wall from one edge or side 96 to an opposite edge or side 98. Similarly, the upper and lower layers of polymer sheet material adjacent to the second end 56 of the side wall 52 are joined to one another by a primary seam 60 that extends entirely across the width of the flattened side wall from one edge or side 96 to an opposite edge or side 98. Each of the primary seams 58 and 60 has a width of approximately ⅜ inch and is formed by, for example, welding the upper and lower layers of polymer sheet material to one another by a process such as ultrasonic welding. When the portions of the side wall 52 adjacent the first and second ends 54 and 56 are joined by the primary seams 58 and 60, respectively, the side wall and the primary seams define an enclosed liner cavity 62 (FIG. 10).

Each of the primary seams 58 and 60 is spaced a short distance, such as about two inches, from its respective end 54 and 56, respectively, of the side wall 52. Closer to or at the first and second ends 54 and 56, the upper and lower layers of polymer sheet material in the flattened side wall 52 are joined by secondary seams 64 and 66, respectively, that extend entirely across the width of the flattened side wall from one edge or side 96 to an opposite edge or side 98. Each of the secondary seams 64 and 66 has a width of approximately ⅜ inch and is formed by, for example, welding the upper and lower layers of polymer sheet material to one another by a process such as ultrasonic welding. Each secondary seam 64 and 66 is spaced a short distance, such as 1½ inches, from its adjacent primary seam 58 and 60, respectively. Each primary seam 58, 60 and its adjacent secondary seam 64, 66 thus define between them a liner sleeve 68, 70 that extends entirely across the width of the flattened side wall from one edge or side 96 to an opposite edge or side 98.

The liner sleeves 68 and 70 are tubular in cross-section and receive straps 72 and 74, respectively. The straps 72 and 74 may be formed of a woven fabric, such as a woven nylon fabric, and are substantially longer than their respective liner sleeves 68 and 70. In particular, the straps 72 and 74 are long enough to extend through the entire length of their respective liner sleeves 68 and 70 and also project at both ends from their liner sleeves to at least approximately a centerline or midpoint 76 of the length of the side wall 52 and the liner 50. In one example embodiment, each strap is approximately 1 inch wide and approximately 36½ feet long.

Closer to the second end 56 of the liner 50 than to the first end 54, an access opening or hole 78 is formed in the side wall 52 to provide access to the liner cavity 62 for filling the liner with a fluid, such as a liquid, and for emptying the liner of its contents. In one example embodiment, the liner 50 is approximately 720 centimeters (cm) in length, and the hole 78 is approximately 163 centimeters (cm) or about 5 feet 4 inches from the second end 56 of the liner, which is about twenty-three percent (23%) of the length of the liner. The access hole 78 receives a fitting 80 that is joined to and sealed to the portion of the side wall 52 immediately adjacent to and surrounding the access hole. The fitting 80 includes a passageway to permit fluid to flow from outside the liner 50 into the liner and from within the liner to outside the liner. A hose 82 (FIG. 9) can be connected at a first end 84 to the fitting 80 to permit the liner 50 to be filled and emptied. In one example embodiment, the hose 82 is formed of polyvinyl chloride (PVC), is 2 inches in diameter, and is approximately 11 feet in length. A second end 86 of the hose 82 opposite the first end 84 is connected to a valve 88 and a coupling 90.

Figure 11:
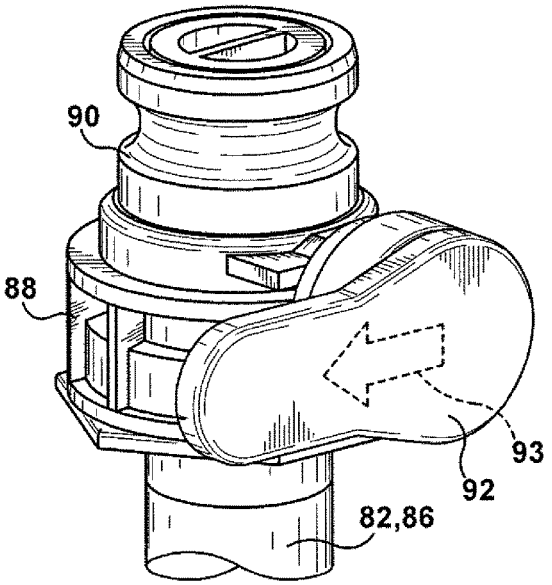
FIG. 11 is a perspective view of a valve and coupling for attachment to one end of a hose connected to the liner of FIG. 2.
Figure 12:
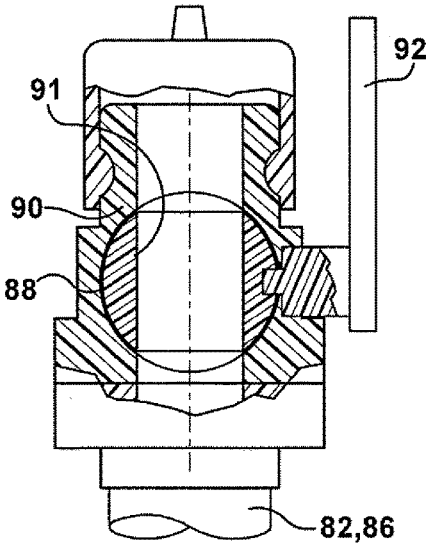
FIG. 12 is a view partly in section of the valve and coupling of FIG. 11.

As shown in FIGS. 11 and 12, the valve 88 is a ball valve operated by a handle 92 that may be grasped by an operator. The handle 92 is directly or indirectly connected to the ball 91 of the valve 88 so that pivoting of the handle produces pivoting of the ball. As illustrated, the handle 92 is removably connected to the ball 91 via a projection 93 at one end of the handle, which has a shape with a specific orientation and which engages a correspondingly shaped socket (not shown) joined to the ball 91. The handle 92 may be removed from the valve 88 by removing the projection 93 from the correspondingly shaped socket (not shown). A removable handle 92 may help prevent damage to the handle during transportation of the tank 26 with an installed and filled liner 50. The handle 92 may, however, be permanently attached to the valve 88. The coupling 90 may be any coupling for connecting an external fill and/or discharge hose 94 (FIG. 1) to the hose 82.

Figure 2:
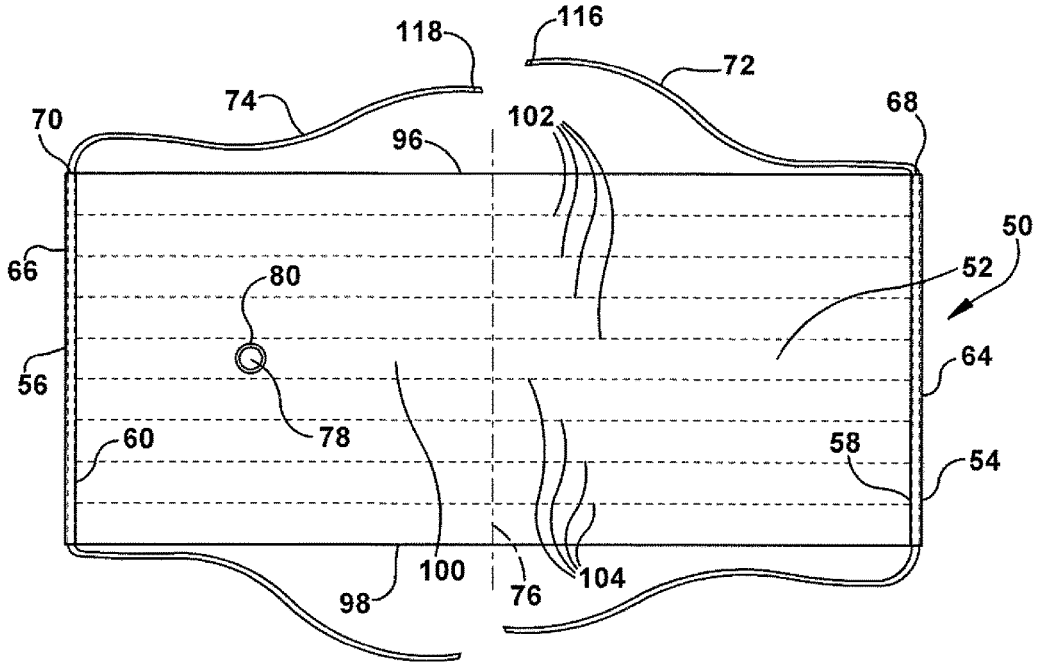
FIG. 2 is a top view of a flattened, unfolded liner for installation in the shipping tank of FIG. 1.

To prepare the liner 50 for loading into the tank 26, the liner is placed in a flattened condition as shown in FIG. 2. In its flattened condition, the liner 50 includes the two straps 72 and 74 and the fitting 80. The straps 72 and 74 are received in their respective liner sleeves 68 and 70, but are otherwise spread out away from the side wall 52 of the liner 50. The fitting 80 is maintained in a position so that it is above the side wall 52. In its flattened condition, the liner 50 has a first edge or side 96 that extends for the length of the liner from the first end 54 to the second end 56. Across the width of the liner 50 is an opposite second edge or side 98 that also extends for the length of the liner from the first end 54 to the second end 56. Between the first and second sides 96 and 98 is a central portion 100 of the liner 50 that extends for the length of the liner from the first end 54 to the second end 56. The central portion 100 of the liner 50 includes the access hole 78 and the fitting 80.

From its flattened condition, the liner 50 folded into a package small enough to pass through the manhole 34 in the side wall 30 of the tank 26. The folding process begins by folding the first and second sides 96 and 98 of the flattened liner 50 toward the central portion 100 of the liner. Specifically, as indicated in FIG. 2, the first side 96 is folded toward the central portion 100 of the liner 50 along a series of spaced apart, parallel fold lines 102. As each fold 103 (FIG. 7) is made, the upper and lower layers of polymer sheet material in the fold are laid on top of the adjoining portion of the upper layer of polymer sheet material. The resulting series of folds 107 resembles a flattened roll of material. Similarly, the second side 98 is folded toward the central portion 100 of the liner 50 along a series of spaced apart, parallel fold lines 104. As each fold 105 (FIG. 7) is made, the upper and lower layers of polymer sheet material in the fold are laid on top of the adjoining portion of the upper layer of polymer sheet material. The resulting series of folds 107 resembles a flattened roll of material. The folds 103 and 105 are shown in cross section (during an unfolding process) in FIGS. 7 and 8.

Figure 3:
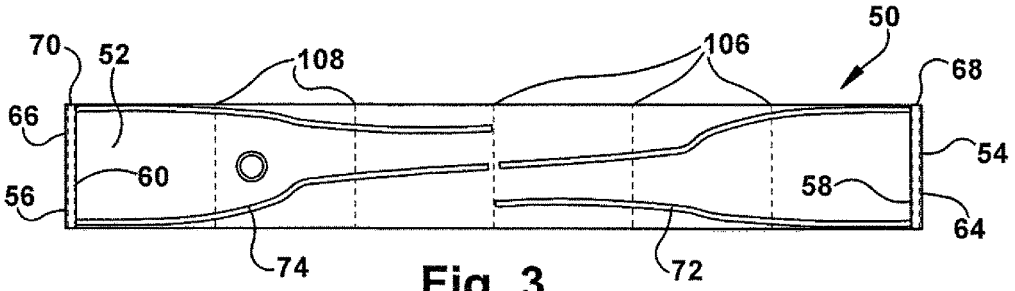
FIG. 3 is a top view of the liner of FIG. 2 in a partially folded condition.

Following the initial part of the folding process as described above, the partially-folded liner 50 has an elongated, relatively narrow rectangular shape, as generally shown in FIG. 3. Although not shown in FIG. 3, two long, narrow, piles of folded polymer sheet material are disposed on opposite sides of the central portion 100 of the liner. The straps 72 and 74 may lie on top of the two piles of folded polymer sheet material, as shown in FIG. 3, or they may be partially folded into the two piles of folded polymer sheet material. For reasons that will become apparent, the straps 72 and 74 should not be allowed to get folded into the first two folds 103 and 105 at either the first side 96 or the second side 98 of the liner 50.

The folding process continues by folding the first and second ends 54 and 56 of the partially-folded liner 50 toward the access hole 78 and the fitting 80 of the liner. Specifically, as indicated in FIG. 3, the first end 54 is folded toward the access hole 78 and the fitting 80 of the liner 50 along at least the first two of a series of spaced apart, parallel fold lines 106. As each fold 107 (FIG. 4) is made, the upper and lower layers of polymer sheet material in the fold are laid on top of the adjoining portion of polymer sheet material. The resulting series of folds 107 resembles a flattened roll of material. Similarly, the second end 56 is folded toward the access hole 78 and the fitting 80 of the liner 50 along at least one of a series of spaced apart, parallel fold lines 108. As each fold 109 (FIG. 4) is made, the upper and lower layers of polymer sheet material in the fold are laid on top of the adjoining portion of polymer sheet material. The resulting series of folds 109 resembles a flattened roll of material. As will be apparent from FIG. 3, beginning with the initial fold 109 along a fold line 108, the fitting 80 will be covered by the folded liner 50. This will result in a bulky fold 109. Consequently, it may be desirable to create more folds 107 from the first end 54 of the liner 50 to offset the bulkiness of the initial fold 109 from the second end 56 of the liner.

Figure 4:
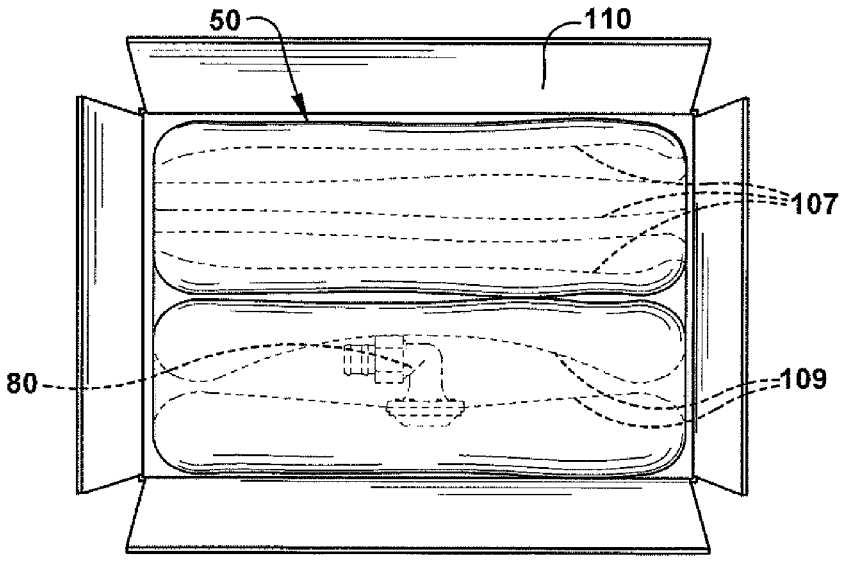
FIG. 4 is a photograph of the liner of FIG. 2 in a fully folded condition.

One embodiment of a liner 50 in its fully folded condition is shown in FIG. 4. As can be seen, the fully folded liner 50 is placed in a box or other container 110 for storage and transportation and, potentially, initial insertion into a tank 26. The container 110 shown in FIG. 4 is merely illustrative of the general packaging concept. In a form suitable for large volume production, the container 110 may be configured and dimensioned to pass through the manhole 34 and may potentially include features to facilitate opening the container inside a tank 26. The container 110 also includes internal protective padding (not shown), such as Styrofoam material, to provide further protection for the liner 50 against being torn or cut by projections or edges associated with the tank 26 and/or an intermediate storage facility.

Figure 5:
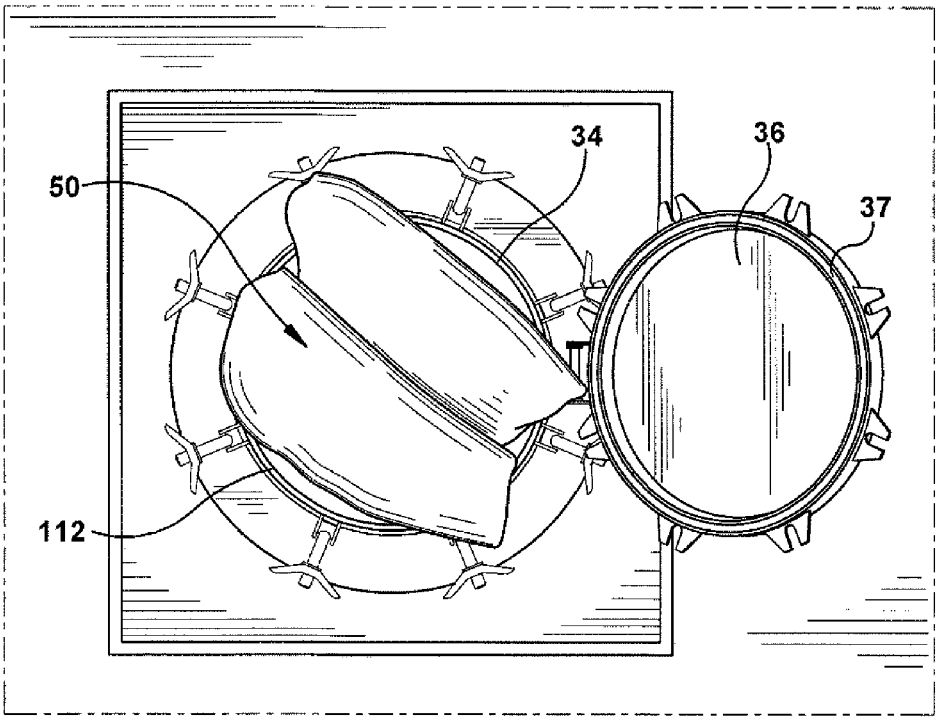
FIG. 5 is a photograph of the liner of FIG. 2 in a fully folded condition about to be placed in a shipping tank.

To install the fully folded liner 50 in a tank 26, the fully folded liner is inserted into the tank through the manhole 34. As previously described, the container 110 may be configured and dimensioned to fit through the manhole 34. Alternatively, the fully folded liner 50 may be placed in a bag, sleeve or cover (not shown) that is woven or otherwise fabricated of a flexible, yet abrasion-resistant material, such as polypropylene (PP). Such a cover (not shown) will protect the liner 50 from abrasion damage as the liner is inserted through the manhole. The fully folded liner 50 may be placed in such a cover (not shown) either before being placed in container 110 or after being removed from the container 110. FIG. 5 illustrates an example embodiment of the fully folded liner 50 being inserted into a tank 26 through a manhole 34. As shown, the fully folded liner 50 is being inserted through the manhole 34 without being enclosed in a container 110 or other protective cover. The liner 50 has been folded, or has become somewhat unfolded during handling, so that the folded liner is slightly larger in width than the diameter of the manhole 34. Thus, a portion of the fully folded liner 50 is overhanging and rubbing against an upwardly projecting collar 112 that surrounds the manhole 34. Although the liner 50 is flexible enough to be pushed past the collar 112, abrasion and/or tearing of the liner is possible. Although such abrasion and/or tearing can be potentially be avoided by folding the liner 50 into a configuration that can fit through the manhole 34 without contacting the collar 112 or another portion of the tank 26, placing the liner 50 in a flexible protective cover or a container 110 that is shaped and dimensioned to fit through the manhole 34 may more reliably protect the liner.

Figure 7:
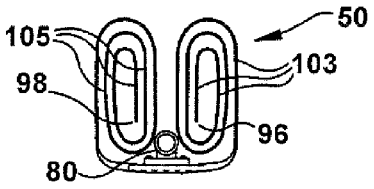
FIG. 7 is a sectional view of the folded liner of FIG. 2 in one stage of being installed in the shipping tank of FIG. 1.

Once the fully folded liner 50 is in the tank cavity 32, the liner may be unfolded. FIG. 6 generally illustrates a fully folded liner 50 being removed from its container 110 inside the tank 26 and being spread out in a flatted condition on a lower interior surface 114 of the side wall 30 of the tank. Within the tank cavity 32, the fully folded liner 50 is unfolded manually by an individual (not shown), who enters the tank cavity through the manhole 34. The fully folded liner 50, which is relatively heavy, is first positioned on the lower interior surface 114 of the side wall 30 of the tank 26 such that the liner, when unfolded, will have its first and second ends 54 and 56 positioned adjacent to the end walls 31 of the tank. The liner 50 is then partially unfolded to the condition shown in FIG. 3, in which the folds 107 and 109 are unfolded. When viewed in a cross-section taken radially of the length of the tank 26, the partially unfolded liner 50 may be configured as shown in FIG. 7. Whether the folds of the liner 50 are on edge, as shown in FIG. 7, or lying flat is a function of the folding process.

Figure 8:
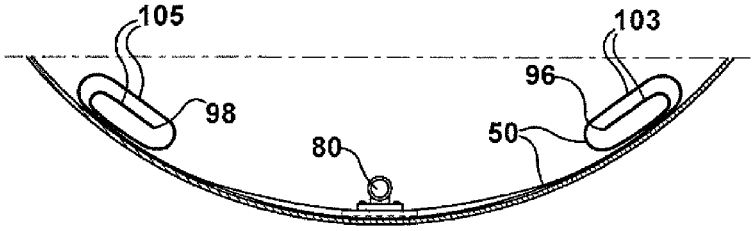
FIG. 8 is a sectional view of the folded liner of FIG. 2 in a second stage of being installed in the shipping tank of FIG. 1.

The partially unfolded liner 50 is then further, but not completely, unfolded by unfolding some, but not all, of the folds 103 and 105 created along the fold lines 102 and 104 shown in FIG. 2. When viewed in a cross-section taken radially of the length of the tank 26, the partially unfolded liner 50 may then be configured as shown in FIG. 8. As shown, three of the folds created along the fold lines 102 and three of the folds created along the fold lines 104 shown in FIG. 2 remain unfolded. Although three folds are shown unfolded adjacent each of the first and second sides 96 and 98 of the liner, only two such folds or only one such fold may be left unfolded, depending on the overall cross-section shape and size of the tank 26.

At this point, the liner 50 is not unfolded further. Instead, the straps 72 and 74 are removed from any remaining folds of the liner in which the straps may be wrapped and are extended toward the manhole 34. If the liner 50 is positioned appropriately and the straps 72 and 74 are appropriately dimensioned, the straps extend through the manhole and the end portions 116 and 118, respectively, of the straps are positioned at the manhole 34 and/or outside of the tank 26. The hose 82 is introduced from outside the tank 26 through the manhole 34, and the first end 84 of the hose is connected to the fitting 80. The external hose 94 is then connected to the coupling 90 attached to the opposite second end 86 of the hose 82. The coupling 90 and its associated valve 88 are maintained at the manhole 34 and/or outside of the tank 26 after being connected to the external hose 94. When the external hose 94 is connected to a source of fluid cargo (not shown) for the tank 26, the valve 88 may be opened by manually operating the handle 92 so that the fluid cargo may fill the liner 50.

Figure 9:
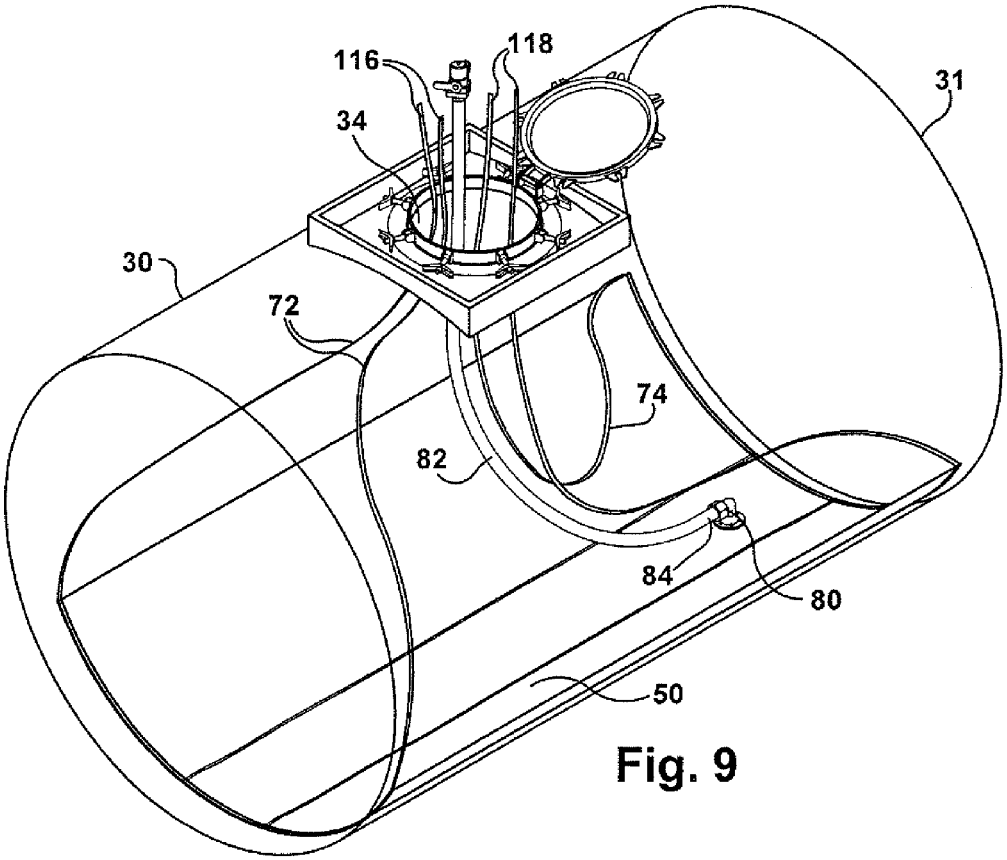
FIG. 9 is an end view of the interior of the shipping tank of FIG. 1 with the folded liner partially unfolded.

As the liner 50 is being filled with a fluid cargo, such as a liquid, the fluid cargo will cause the remaining folds shown in FIGS. 8 and 9 to unfold. With the end portions 116 and 118 of the straps 72 and 74, respectively, and the coupling 90 and its associated valve 88 located at the manhole 34 and/or outside of the tank 26, the straps and the hose 82 should remain on top of the partially and, ultimately, completely filled liner 50, as shown in FIG. 10. The individual (not shown) responsible for filling the liner 50 and the tank 26 may, however, need to monitor the filling process and adjust the positions of the straps 72 and 74 and the hose 82, as required, to ensure that the straps and the hose are not trapped against, for example, the side wall 30 or end walls 31 of the tank by the liner as it fills. When the liner 50 and, therefore, the tank 26 are filled to a desired volume, the valve 88 may be closed and the external hose 94 may be disconnected from the coupling 90.

Figure 13:
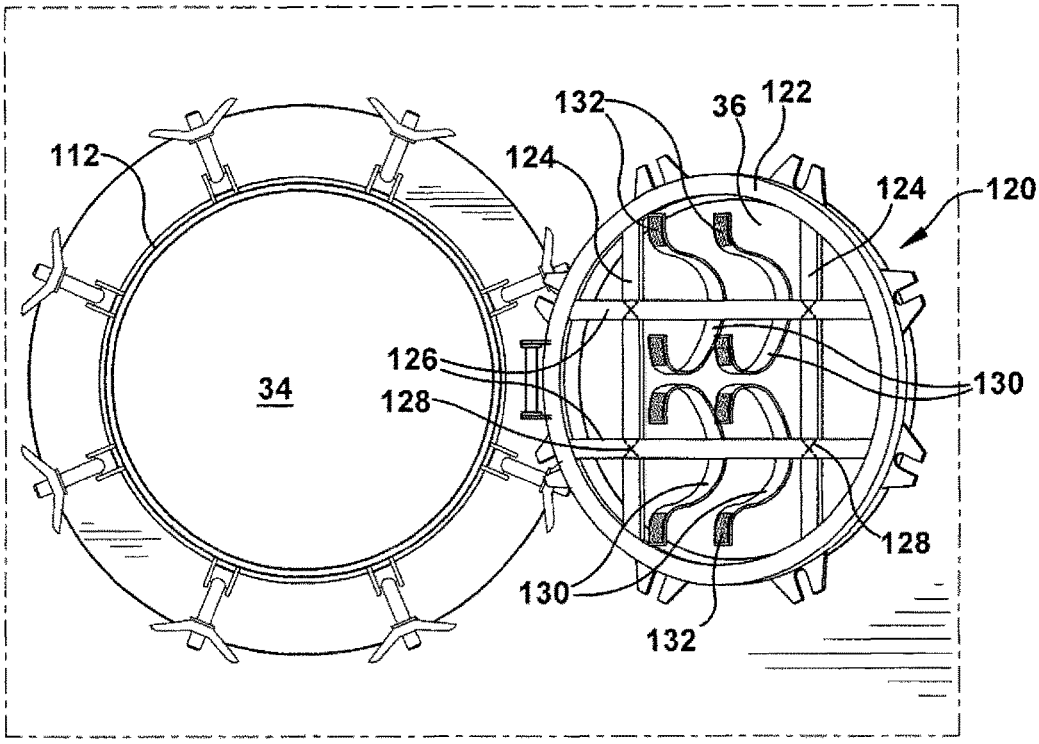
FIG. 13 is a bottom plan view of the manhole lid of the shipping tank of FIG. 1 with an apparatus for releasably attaching a hose and valve to the manhole lid.
Figure 14:
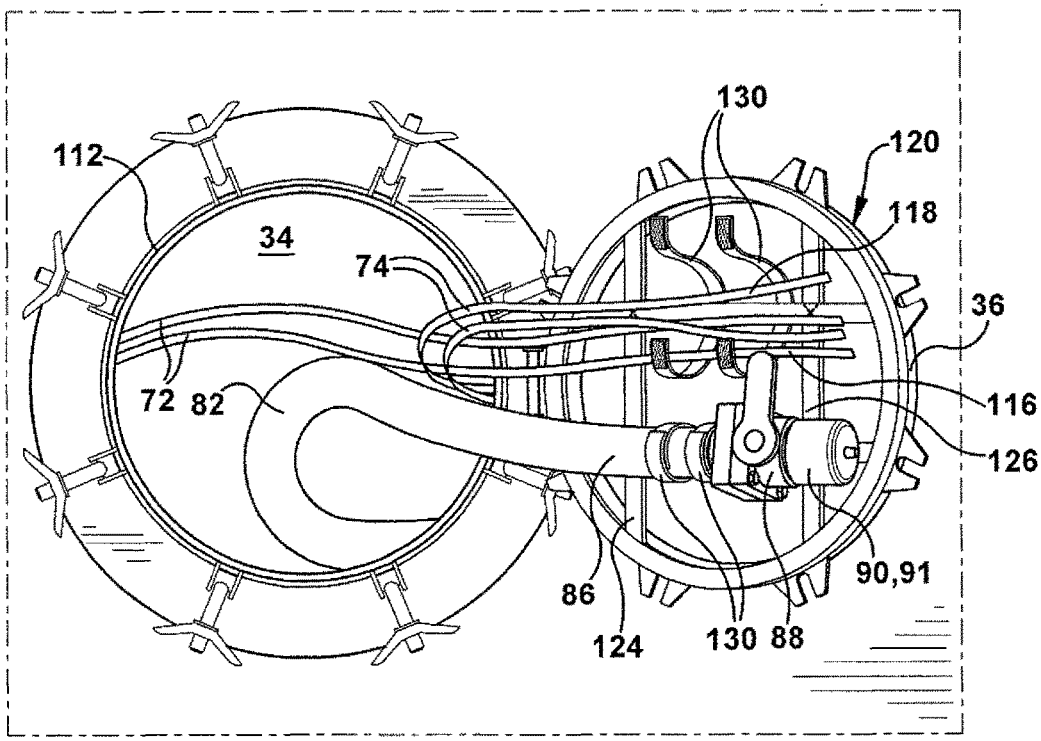
FIG. 14 is a schematic side view of the manhole lid and apparatus of FIG. 13 with an attached hose and valve.

Before the manhole lid 36 is closed to permit the tank 26 to be loaded on, for example, the truck 22, a rail car (not shown), or a container ship (not shown), the valve 88 and the coupling 90 and, therefore, the attached second end 86 of the hose 82 are releasably attached to the manhole lid. An example of an attachment apparatus 120 for releasably attaching the valve 88 and coupling 90 to the manhole lid 36 is shown in FIGS. 13 and 14. The attachment apparatus 120 includes a lid gasket 122, two cross straps 124, two attachment straps 126, and four engagement elements or loops 130. The lid gasket 122 is a body of flexible material and may be a known lid gasket for sealing the interface between the manhole lid 36 and the upwardly projecting collar 112 that encircles the manhole 34. The lid gasket 122 is circular in shape and may formed of any suitable sealing material capable of maintaining a circular shape and provide mechanical support for the cross straps 124, the attachment straps 126, the valve 88, and the coupling 90. One material suitable for the lid gasket 122 is polytetrafluoroethylene (PTFE).

Each cross strap 124 extends across the circular lid gasket 122 as a chord of a circle. The cross strap 124 is attached at its opposite ends to the lid gasket 122. The attachment straps 126 also extend across the circular lid gasket 122 as chords of a circle. The attachment straps 126 extend perpendicular to the cross straps 124. At the intersections 128 where the attachment straps 126 cross over the cross straps 124, the attachments straps are joined to the cross straps. The cross straps 124 and the attachment straps 126 may be formed of any suitable material, such as a woven nylon fabric. If the cross straps 124 and the attachment straps 126 are formed of a fabric material, they may be sewn together at the intersections 128.

Between the two intersections 128 that occur along the length of each attachment strap 126, two engagement elements or loops 130 are sewn or otherwise connected to the attachment straps. Each engagement loop 130 may be formed of a fabric material, such as woven nylon fabric. Each engagement loop 130 is also separated into two parts that may be releasably joined by a fastening device 132, such as a hook-and-loop fastener of the type sold under the brand name Velcro.

The attachment apparatus 120 is mounted to the manhole lid 36 by placing the lid gasket 122 around an upwardly projecting lip 37 (FIG. 5) adjacent the outer perimeter or circumference of the manhole lid, when the manhole lid is in its open position, with the cross straps 124 and the attachment straps 126 adjacent the interior surface of the manhole lid presented toward the tank cavity 32. The close fit between the lid gasket 122 and the outer circumference of the manhole lid 36 will retain the attachment apparatus 120 on the manhole lid. In addition to the engagement between the lid gasket 122 and the lip 37, after the manhole lid 36 is closed, the lid gasket 122 will be trapped and held between the manhole lid and the collar 112 surrounding the manhole 34. To attach the valve 88, the coupling 90, and the second end 86 of the hose 82 to the manhole lid 36, the engagement loops 130 are wrapped around one or more of those components and the fastening devices 132 are closed. The engagement loops 130 thus contact the second end 86 of the hose 82, the valve 88, and/or the coupling 90 and secure the second end of the hose, the valve, and/or the coupling to the attachment straps 126.

If the hose 82 has a relatively small diameter and the coupling 90 and the valve 88 are correspondingly small in size, the two parts of a single engagement loop 130 may be joined around the hose and/or the coupling and/or the valve. If the hose 82 has a relatively large diameter and the coupling 90 and the valve 88 are correspondingly large in size, the two parts of two adjacent engagement loops 130 may be joined in a continuous loop around the hose and/or the coupling and/or the valve. This approach provides a loop for attachment approximately twice the diameter of a single engagement loop 130. The engagement loops 130 may also be used to hold the end portions 116 and 118 of the straps 72 and 74, respectively. Alternatively, the end portions 116 and 118 of the straps 72 and 74, respectively, may be wrapped around or tied to the cross straps 124 or the attachment straps 126.

With the valve 88, the coupling 90, and the second end 86 of the hose 82 attached to the manhole lid 36 via the attachment apparatus 120, as shown in FIG. 14, the manhole lid may be pivoted into a closed position against the collar 112 to cover the manhole 34, close the tank 26, and seal the tank cavity 32. Because the valve 88 is also closed, the liner 50 is closed and the liner cavity 62 is sealed. In addition, because the valve 88, the coupling 90, and the second end 86 of the hose 82 are attached to the manhole lid 36 via the attachment apparatus 120, together with the end portions 116 and 118 of the straps 72 and 74, the valve, the coupling, the second end 86 of the hose 82, and the ends of the straps will all be conveniently presented to an individual who manually pivots the manhole lid 36 into an open position to uncover the manhole 34, open the tank 26, and unseal the tank cavity 32 at the destination for the tank 26. The individual may then quickly and conveniently release the engagement loops 130 and connect the coupling 90 to an external hose 94 to permit the liner 50 and, therefore, the tank 26 to be unloaded of its cargo.

As the unloading of the fluid cargo from the liner 50 is nearing a conclusion, it may be increasingly difficult for the fluid cargo to reach the fitting 80. The straps 72 and 74 may then be used to pull upward on the first and second ends 54 and 56 of the liner 50 to cause the fluid cargo to flow toward the fitting 80 for more complete emptying of the fluid cargo from the liner and the tank 26. Moreover, when the fluid cargo is complete emptied from the liner 50 or emptied to the extent practical, the straps 72 and 74 may be used to help remove the empty or nearly empty liner from the tank cavity 32.

As will be apparent from the foregoing description, the valve 88 and the coupling 90 and, therefore, the attached second end 86 of the hose 82 are "releasably attached" to the manhole lid in the sense that that attachment is released at the election of and as a consequence of an action taken by an individual. When the manhole lid 36 is in its closed position covering the manhole 34, the valve 88, the coupling 90, and the second end 86 of the hose 82 will remain attached to the manhole lid. As the manhole lid 36 is opened and is moved from its closed position covering the manhole 34 to its open position uncovering the manhole, as shown, for example, in FIG. 5, the valve 88, the coupling 90, and the second end 86 of the hose 82 may or may not move with the manhole lid, depending upon, for example, the length of the engagement elements. When the manhole lid 36 reaches its fully open position, the valve 88, the coupling 90, and the second end 86 of the hose 82 can be released from the manhole lid by an individual, either directly or, possibly, by a remotely operated device.

Figure 15:
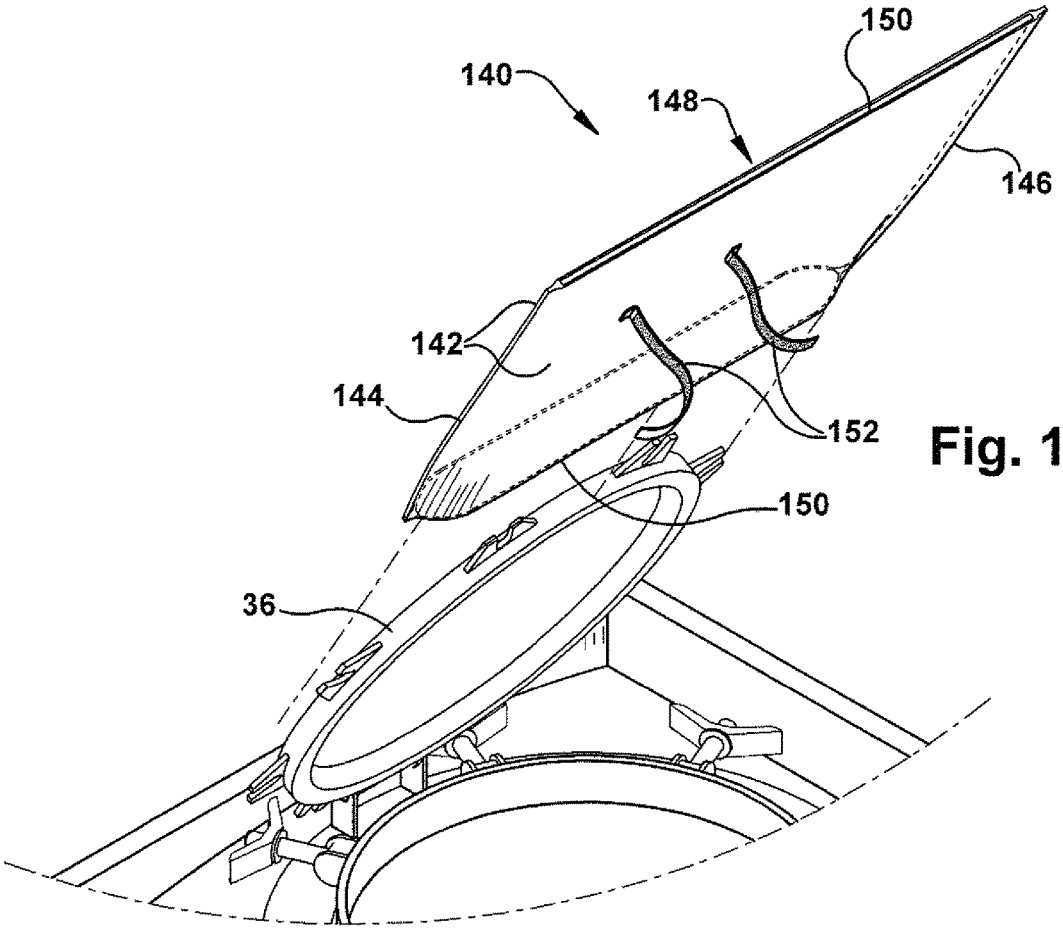
FIG. 15 is a perspective view of an alternative apparatus for releasably attaching a hose and valve to the manhole lid of the shipping tank of FIG. 1.

FIG. 15 illustrates an alternative attachment apparatus 140 for releasably attaching the valve 88 and coupling 90 to the manhole lid 36. The attachment apparatus 140 includes two sheets 142 of neoprene elastomer. As shown, the sheets 142 are rectangular in shape and are aligned one above the other. Each sheet 142 includes two opposed edges 144 and 146 spaced apart across the length or width of the sheet. The aligned edges 144 of the two sheets 142 are joined together by, for example, heat sealing. Similarly, the aligned edges 146 of the two sheets 142 are also joined together by, for example, heat sealing. The resulting structure is a sleeve 148 with opposed open ends 150. The sleeve 148 can be slipped over the manhole lid 36. Mounted to one of the sheets 142 are two engagement elements or loops 152. The mounting may be accomplished by fusing the engagement loops 152 to the sheet 142. Each engagement loop 152 may be formed of a fabric material, such as woven nylon fabric. Each engagement loop 152 may also separated into two parts (not shown) that may be releasably joined by a fastening device (not shown), such as a hook-and-loop fastener of the type sold under the brand name Velcro. When the sleeve 148 is slipped over the manhole lid 36, the engagement loops 152 are presented toward the interior of the tank cavity 32. The sleeve 148 thus corresponds to both the lid gasket 122 and the attachment straps 126 of FIGS. 13 and 14.

Figure 16:
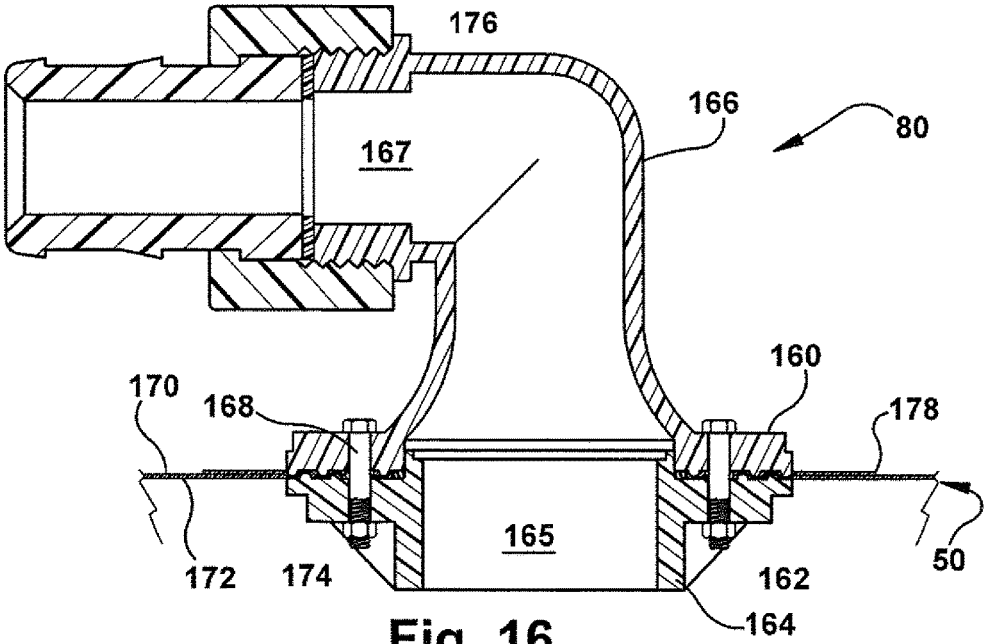
FIG. 16 is a side view, partially in section, of a fitting for attaching a hose to the tank liner of FIG. 2.

In FIGS. 2 and 3, for example, the fitting 80 is illustrated schematically as a straight tube. The details of the fitting 80 are illustrated in FIG. 16. The fitting 80 includes an annular upper flange 160, an annular lower flange 162, a strainer 164, and an elbow 166. A passageway 167 extends through the elbow 166 to permit fluid to flow through the elbow. A corresponding passageway 165 extends through the strainer 164 to permit fluid to flow through the strainer. The upper flange 160 is placed against an exterior surface 170 of the liner 50. The lower flange 162 is placed against an interior surface 172 of the liner 50. The upper and lower flanges 160 and 162 are tightly joined together by fasteners 168, such as bolts and nuts, that pass through appropriately sized openings (not shown) in the upper and lower flanges and the liner 50. The liner 50 is sandwiched and sealed between the upper and lower flanges 160 and 162. The strainer 164 is attached to the lower flange 162 inside the liner cavity 62 by, for example, mating screw threads 174 on the strainer and the lower flange. The elbow 166 is attached to the upper flange 160 outside the liner cavity 62 by, for example, mating screw threads 176 on the elbow and the upper flange. The passageways 165 and 167 communicate with one another through the upper flange 160. An additional piece of material 178 may be placed around the fitting 80 and between the upper and lower flanges 160 and 162 to reinforce the material of the liner 50.

FIGS. 17 through 23 illustrate a flexible liner 200 that is constructed in accordance with a second example of the present invention. Like the liner 50 shown in FIGS. 2 and 3, the liner 200 is fabricated from flexible polymer sheet material. Unlike the liner 50, however, the liner 200 is an assembly of an outer liner 202 and an inner liner 204. The outer liner 202 is separate and distinct from the inner liner 204, except for a connection between a defined area of the outer liner and an adjacent defined area of the inner liner, as will be explained in more detail below.

The flexible polymer sheet material from which the outer liner 202 is formed is clear, low-density polyethylene (LDPE), which is about 8 mils or 200 microns in thickness. The polymer sheet material may, alternatively, be formed of multiple layers of different polymers, such as linear low-density polyethylene (LLDPE) and ethylene vinyl alcohol (EVOH), bonded together. The outer liner 202 has a side wall 212 that extends for the length of the outer liner, which length may be about 7,300 millimeters (mm). The side wall 212 is formed as a tube or loop, like a right circular cylinder. The side wall 212 has a first end 214 and a second end 216 that are spaced apart by the length of the side wall, which is also the length of the outer liner 202. The first and second ends 214 and 216 of the side wall 212 are also the first and second ends of the outer liner 202.

To form the outer liner 202, the side wall 212 is flattened so that it has a rectangular shape, in plan view, with two portions of the side wall lying on top of one another to provide an upper layer 212*a* (FIG. 18) and a lower layer 212*b* of polymer sheet material. The upper and lower layers 212*a* and 212*b* of polymer sheet material adjacent to the first end 214 of the side wall 212 are joined to one another by a primary seam 218 that extends entirely across the width of the flattened side wall from one edge or side 276 to an opposite edge or side 278. The width of the flattened side wall 212 may be about 3,880 millimeters (mm). Similarly, the upper and lower layers 212*a* and 212*b* of polymer sheet material adjacent to the second end 216 of the side wall 212 are joined to one another by a primary seam 220 that extends entirely across the width of the flattened side wall from one edge or side 276 to the opposite edge or side 278. Each of the primary seams 218 and 220 has a width of approximately ⅜ inch and is formed by, for example, welding the upper and lower layers 212*a* and 212*b* of polymer sheet material to one another by a process such as ultrasonic welding.

Figure 18:
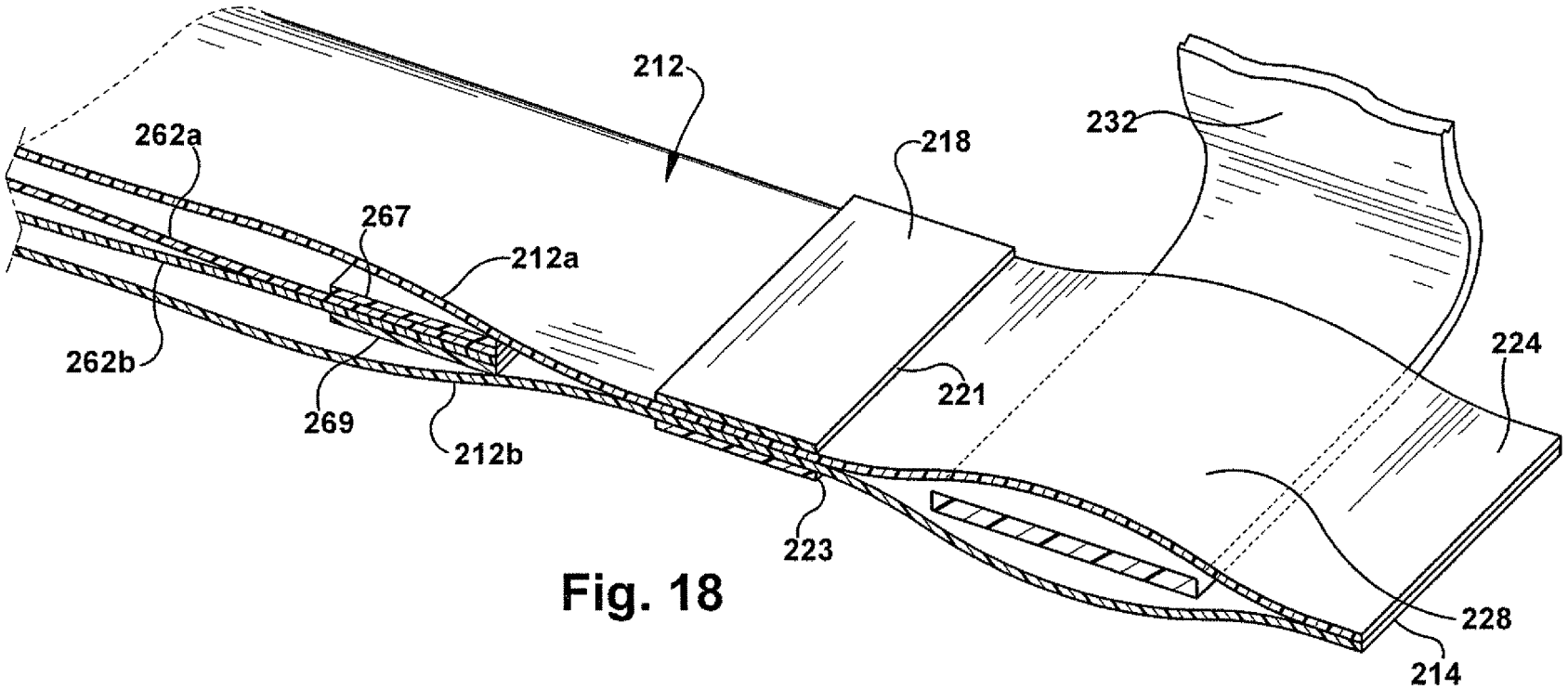
FIG. 18 is an enlarged view, partly in section, of a portion of the flattened, unfolded liner of FIG. 17.
Figure 20:
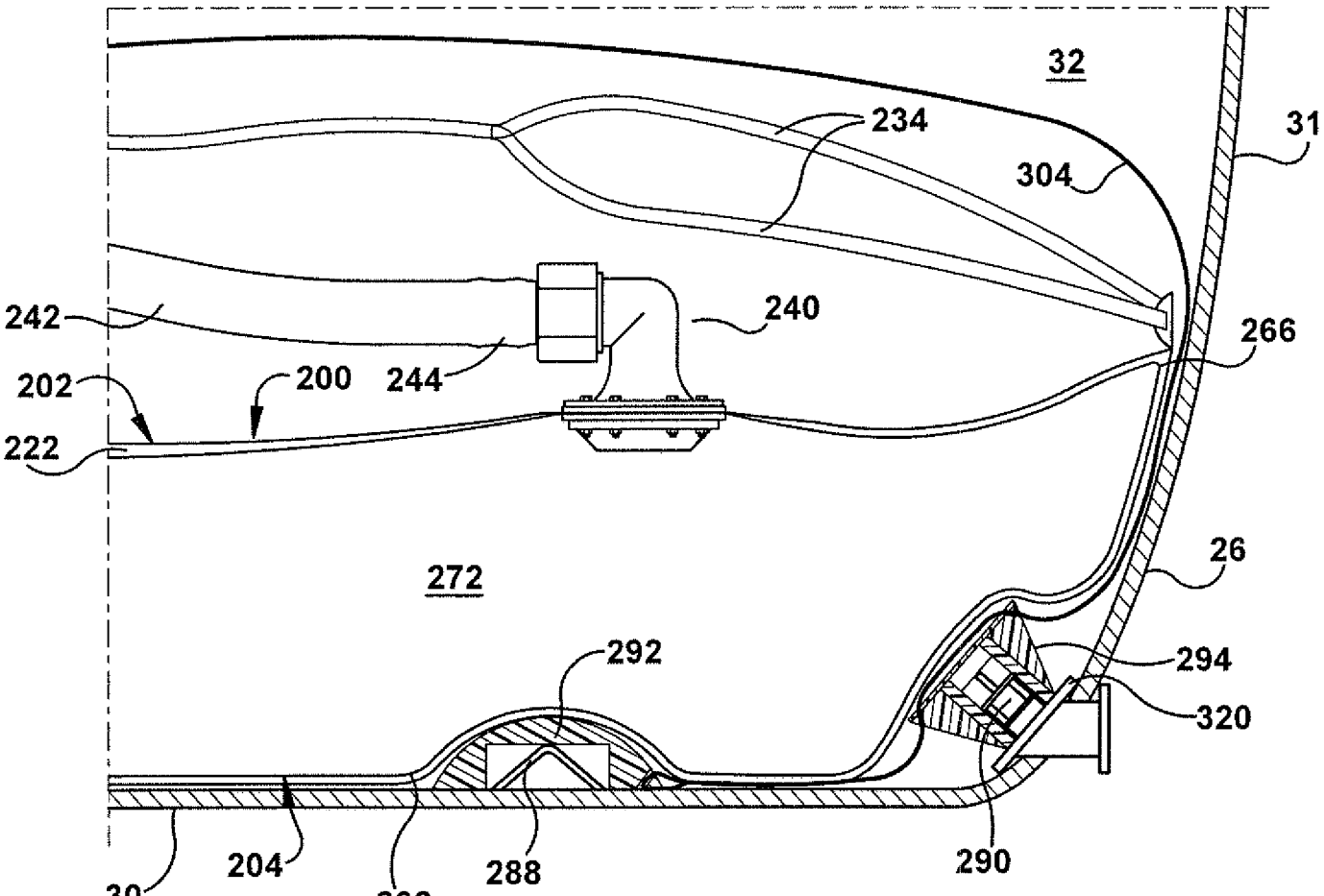
FIG. 20 is a schematic side view of the interior of a shipping tank similar to the shipping tank of FIG. 1 showing a bottom valve and a guider pin that project into the interior of the shipping tank.

Each of the primary seams 218 and 220 is reinforced by two strips of clear LDPE, each of which has a thickness of about 8 mils. More specifically, as shown in FIG. 18, a first reinforcement strip 221 is positioned in contact with and above (as viewed in FIG. 18) the upper layer 212*a* of the flattened side wall 212. A second reinforcement strip 223 is positioned in contact with and below (as viewed in FIG. 18) the lower layer 212*b* of the flattened side wall 212. Each of the first and second reinforcement strips 221 and 223 extends entirely across the width of the flattened side wall 212 from one side 276 to the opposite side 278. Each of the first and second reinforcement strips 221 and 223 is secured to the adjacent layer 212*a* and 212*b* of sheet material of the flattened side wall 212 by, for example, welding using a process such as ultrasonic welding. The welding of the first and second reinforcement strips 221 and 223 to the adjacent layers 212*a* and 212*b* of polymer sheet material and the welding of the upper and lower layers of polymer sheet material to one another may be carried out in a single welding step. The other primary seam 220 adjacent the second end 216 of the side wall 212 is reinforced with reinforcement strips (not shown) in the same manner as the primary seam 218 shown in FIG. 18. When the portions of the side wall 212 adjacent the first and second ends 214 and 216 are joined by the primary seams 218 and 220, respectively, the side wall and the primary seams define an enclosed outer liner cavity 222 (FIG. 20).

Each of the primary seams 218 and 220 is spaced a short distance from its respective end 214 and 216, respectively, of the side wall 212. The primary seams 218 and 220 are positioned relative to the first and second ends 214 and 216, respectively, of the outer liner 202 such that each end is spaced a distance of approximately 50 millimeters (mm) from the closest reinforcement strip for a primary seam. For example, with reference to FIG. 18, the distance between the first end 214 of the side wall 212 of the outer liner 202 and the adjacent edge of the reinforcement strip 221 is approximately 50 mm. At or close to the first and second ends 214 and 216, the upper and lower layers 212*a* and 212*b* of polymer sheet material in the flattened side wall 212 are joined by secondary seams 224 and 226, respectively, which extend entirely across the width of the flattened side wall. Each of the secondary seams 224 and 226 has a width of approximately ⅜ inch and is formed by, for example, welding the upper and lower layers 212*a* and 212*b* of polymer sheet material to one another by a process such as ultrasonic welding and. Each secondary seam 224 and 226 is thus spaced a short distance, such as 1-½ inches, from the closest reinforcement strip for its adjacent primary seam 218 and 220, respectively. Each primary seam 218, 220 and its adjacent secondary seam 224, 226 thus define between them a liner sleeve 228, 230 (FIG. 18) that extends entirely across the width of the flattened side wall from one side 276 to the opposite side 278.

The liner sleeves 228 and 230 are tubular in cross-section and receive straps 232 and 234, respectively. The straps 232 and 234 may be formed of a woven fabric, such as a woven nylon fabric, and are substantially longer than their respective liner sleeves 228 and 230. In particular, the straps 232 and 234 are long enough to extend through the entire length of their respective liner sleeves 228 and 230 and also project at both ends from their liner sleeves. Nonetheless, while the straps 72 and 74 shown in FIGS. 2 and 3 project out of their respective liner sleeves 68 and 70 without any intended overlap, each of the straps 232 and 234 is connected to itself after projecting out of its respective liner sleeve 228, 230. The portion of each strap 232, 234 that projects from the corresponding liner sleeve 228, 230 thus has an overall shape resembling a Y. Each strap 232, 234 extends to or slightly beyond a centerline or midpoint 236 of the length of the side wall 212 and the outer liner 202. The projecting portion of each strap 232, 234 may be covered by a separate protective sleeve or cover 233, 235 made, for example, of polypropylene (PP) to help prevent the strap from marking the inside surface of a tank, such as a tank 26. In one example embodiment, each strap 232, 234 is approximately 20 mm wide.

When the straps 232 and 234 are received in their respective liner sleeves 228 and 230, respectively, an exterior reinforcement element 274 is added to the outer liner 202. The exterior reinforcement element 274 (which is not shown in FIG. 18) is an elongated band of woven polypropylene (PP) fabric that extends from a first end 214 of the outer liner 202 to the opposite second end 216. At each of the first and second ends 214 and 216 of the outer liner 202, the exterior reinforcement element 274 is wrapped around the exterior of the corresponding liner sleeve 228, 230 so that each end portion of the exterior reinforcement element overlaps an adjacent portion of the exterior reinforcement element. The exterior reinforcement element 274 is then sewn to each of the liner sleeves 228, 230. In the sewing process, the stitching 275 passes through the exterior reinforcement element 274, through one layer of a liner sleeve 228, 230, through a corresponding strap 232, 234, through a second layer of the liner sleeve 228, 230, and through the overlapping end portion of the exterior reinforcement element. Each of the straps 232, 234 is thus sewn to its corresponding liner sleeve 228, 230 and to the exterior reinforcement element 274. The straps 232, 234 will not, therefore, slide through the corresponding liner sleeves 228, 230.

Closer to the second end 216 of the outer liner 202 than to the first end 214, an access opening or hole 238 is formed in the side wall 212 and in the exterior reinforcement element 274 to provide access to the outer liner cavity 222 for filling the liner 200 with a fluid, such as a liquid, and for emptying the liner of its contents. In one example embodiment, the outer liner 202 is approximately 720 centimeters (cm) in length, and the hole 238 is approximately 163 centimeters (cm) or about 5 feet 4 inches from the second end 216 of the liner, which is about twenty-three percent (23%) of the length of the liner. The access hole 238 receives a fitting 240 that is joined to and sealed to the portion of the exterior reinforcement element 274 and the portion of the side wall 212 surrounding the access hole. The fitting 240 includes a passageway (not shown in FIG. 17) to permit fluid to flow from outside the liner 200 into the liner and from within the liner to outside the liner. A hose 242 (FIG. 20) can be connected at a first end 244 to the fitting 240 to permit the liner 200 to be filled and emptied. In one example embodiment, the hose 242 is formed of polyvinyl chloride (PVC), is 2 inches in diameter, and is approximately 11 feet in length. The second end 246 (FIG. 19) of the hose 242 opposite the first end 244 is connected to a valve 248 and a coupling 250. The valve 248 and the coupling 250 are substantially the same as the valve 88 and the coupling 90 shown in FIGS. 11 and 12. Specifically, the valve 248 is a ball valve operated by a handle 252 that may be grasped by an operator. The coupling 250 may be any coupling for connecting an external fill hose to the hose 242.

Within the outer liner 202 and, more particularly, inside the enclosed outer liner cavity 222 is the inner liner 204. The inner liner 204 is formed from a flexible polymer sheet material that is clear, low-density polyethylene (LDPE), which is about 8 mils or 200 microns in thickness. The polymer sheet material may, alternatively, be formed of multiple layers of different polymers, such as linear low-density polyethylene (LLDPE) and ethylene vinyl alcohol (EVOH), bonded together. The inner liner 204 has a side wall 262 that extends for the length of the inner liner, which length may be about 7,200 millimeters (mm). The side wall 262 is formed as a tube or loop, like a right circular cylinder. The side wall 262 has a first end 264 and a second end 266 that are spaced apart by the length of the side wall, which is also the length of the inner liner 204. The first and second ends 264 and 266 of the side wall 262 are also the first and second ends of the inner liner 204.

To form the inner liner 204, the side wall 262 is flattened so that it has a rectangular shape, in plan view, with two portions of the side wall lying on top of one another to provide an upper layer 262*a* (FIG. 18) and a lower layer 262*b* of polymer sheet material. The upper and lower layers 262*a* and 262*b* of polymer sheet material adjacent to the first end 264 of the side wall 262 are joined to one another by a primary seam 268 that extends entirely across the width of the flattened side wall. The width of the flattened side wall 262 may be about 3,880 millimeters (mm). Similarly, the upper and lower layers 262*a* and 262*b* of polymer sheet material adjacent to the second end 266 of the side wall 262 are joined to one another by a primary seam 270 that extends entirely across the width of the flattened side wall. Each of the primary seams 268 and 270 is located at or immediately adjacent to its respective end 264 and 266, respectively, of the side wall 262. Each of the primary seams 268 and 270 has a width of approximately ⅜ inch and is formed by, for example, welding the upper and lower layers of polymer sheet material to one another by a process such as ultrasonic welding.

Each of the primary seams 268 and 270 is reinforced by two strips of clear LDPE, each of which has a thickness of about 8 mils. More specifically, a first reinforcement strip 267 is positioned in contact with and above (as viewed in FIG. 18) the upper layer 262*a* of the flattened side wall 262. A second reinforcement strip 269 is positioned in contact with and below (as viewed in FIG. 18) the lower layer 262*b* of the flattened side wall 262. Each of the first and second reinforcement strips 267 and 269 extends entirely across the width of the flattened side wall 262 from one side to the opposite side. Each of the first and second reinforcement strips 267 and 269 is secured to the adjacent layer 262*a* and 262*b* of sheet material of the flattened side wall 262, for example, welding using a process such as ultrasonic welding. The welding of the first and second reinforcement strips 267 and 269 to the adjacent layers 262*a* and 262*b* of polymer sheet material and the welding of the upper and lower layers of polymer sheet material to one another may be carried out in a single welding step. The other primary seam 270 adjacent the second end 266 of the side wall 262 is reinforced with reinforcement strips (not shown) in the same manner as the primary seam 268. When the portions of the side wall 262 adjacent the first and second ends 264 and 266 are joined by the primary seams 268 and 270, respectively, the side wall and the primary seams define an enclosed inner liner cavity 272 (FIG. 20).

Closer to the second end 266 of the inner liner 204 than to the first end 264, an access opening or hole (not shown) is formed in the side wall 262 to provide access to the inner liner cavity 272 for filling the liner 200 with a fluid, such as a liquid, and for emptying the liner of its contents. The access hole (not shown) in the inner liner 204 is positioned so as to be aligned with the access hole 238 in the outer liner 202 when the inner liner is received in the outer liner cavity 222. The access hole (not shown) in the inner liner 204 receives a portion of the fitting 240. The portion of the fitting 240 that extends into the inner liner 204 is joined to and sealed to the portion of the side wall 262 of the inner liner surrounding the access hole (not shown). The inner liner 204 and the outer liner 202 are thus joined together by the fitting 240 in the areas of the inner and outer liners immediately adjacent to and surrounding their respective access holes.

Figure 17:
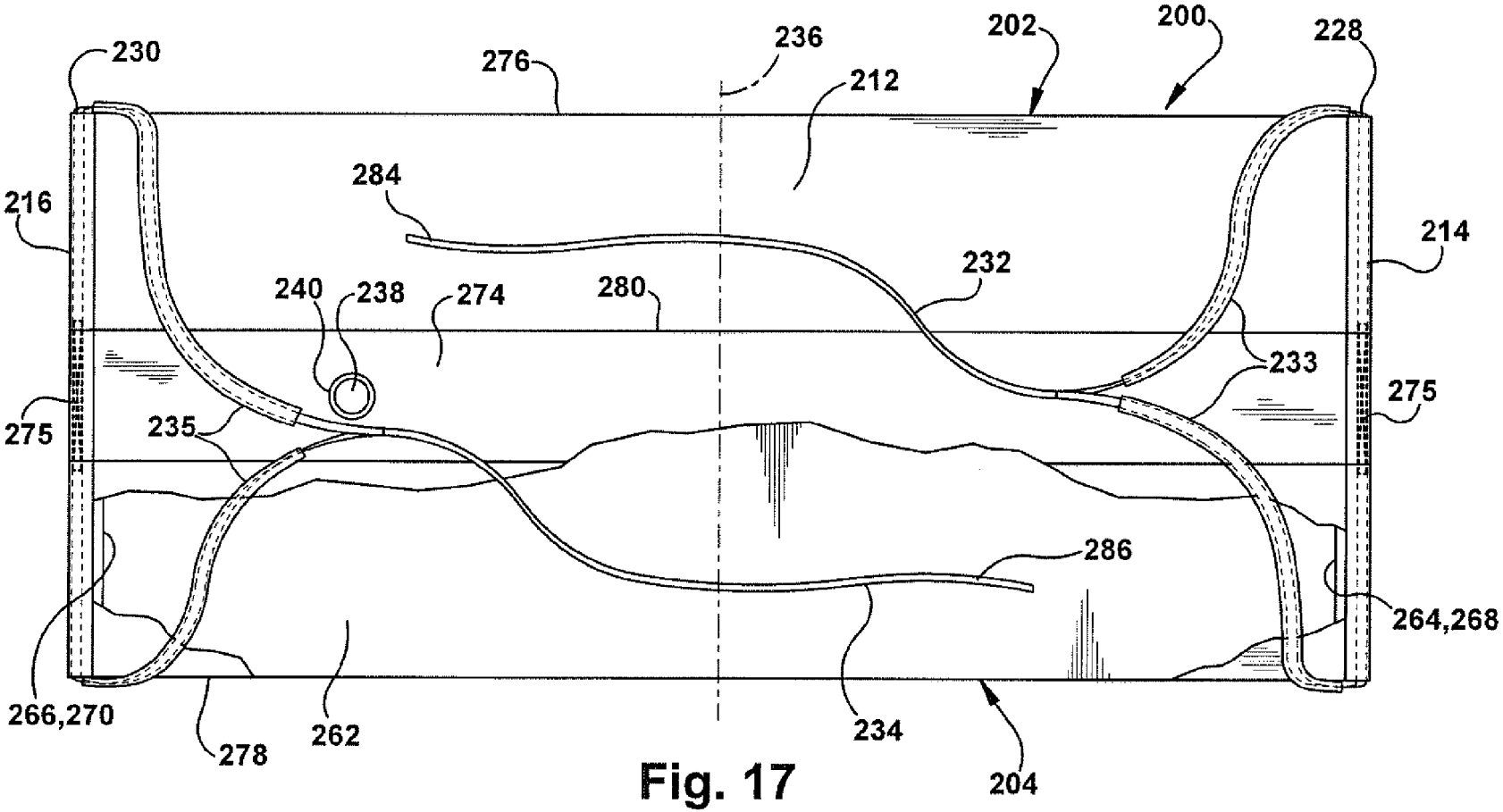
FIG. 17 is a top view of a flattened, unfolded liner in accordance with a second embodiment of the invention for installation in the shipping tank of FIG. 1.

To prepare the liner 200 for loading into a tank such as the tank 26, the liner is assembled with the inner liner 204 inside the outer liner 202. The assembled liner 200 is placed in a flattened condition as shown in FIG. 17. In its flattened condition, the liner 200 includes the two straps 232 and 234 and the fitting 240. The straps 232 and 234 are received in their respective liner sleeves 228 and 230, but should otherwise be spread out away from the side wall 212 of the outer liner 202. The fitting 240 is maintained in a position so that it is above the side wall 212. In its flattened condition, the liner 200 has a first side 276 that extends for the length of the liner from the first end 214 of the outer liner 202 to the second end 216 of the outer liner. Across the width of the liner 200 is an opposite second side 278 that also extends for the length of the liner from the first end 214 of the outer liner to the second end 216 of the outer liner. Between the first and second sides 276 and 278 is a central portion 280 of the liner 200 that extends for the length of the liner from the first end 214 of the outer liner 202 to the second end 216 of the outer liner. The central portion 280 of the liner 200 includes the access hole 238 and the fitting 240 and is generally coextensive with the width of the exterior reinforcement element 274.

From its flattened condition, the liner 200 folded into a package small enough to pass through the manhole 34 in the side wall 30 of the tank 26. The folding process begins by folding the first and second sides 276 and 278 of the flattened liner 200 toward the central portion 280 of the liner. Similar to the folding process shown in FIG. 2 for the liner 50, the first side 276 is folded toward the central portion 280 of the liner 200 along a series of spaced apart, parallel fold lines (not shown). As each fold is made, the upper and lower layers of polymer sheet material in the fold are laid on top of the adjoining portion of the upper layer of polymer sheet material. The resulting series of folds resembles a flattened roll of material. Thereafter, similar to the process shown in FIG. 2 for the liner 50, the second side 278 is folded toward the central portion 280 of the liner 200 along a series of spaced apart, parallel fold lines (not shown). As each fold is made, the upper and lower layers of polymer sheet material in the fold are laid on top of the adjoining portion of the upper layer of polymer sheet material. The resulting series of folds resembles a flattened roll of material. The folds will resemble the folds 103 and 105 shown in cross section (during an unfolding process) in FIGS. 7 and 8.

Following the initial part of the folding process as described above, the partially-folded liner 200 has an elongated, relatively narrow rectangular shape, similar to the shape of the partially folded liner 50 shown in FIG. 3. Two long, narrow, piles of folded polymer sheet material are disposed on opposite sides of the central portion 280 of the liner 200. The straps 232 and 234 may lie on top of the two piles of folded polymer sheet material or they may be partially folded into the two piles of folded polymer sheet material. For reasons that will become apparent, the straps 232 and 234 should not be allowed to get folded into the first two folds at either the first side 276 or the second side 278 of the liner 200.

The folding process continues by folding the first and second ends 214 and 216 of the partially-folded liner 200 toward the access hole 238 and the fitting 240 of the liner. Specifically, similar to the folding process shown in FIG. 3 for the liner 50, the first end 214 is folded toward the access hole 238 and the fitting 240 of the liner 200 along at least the first two of a series of spaced apart, parallel fold lines. As each fold is made, the upper and lower layers of polymer sheet material in the fold are laid on top of the adjoining portion of polymer sheet material. The resulting series of folds resembles a flattened roll of material. Similarly, the second end 216 is folded toward the access hole 238 and the fitting 240 of the liner 200 along at least one of a series of spaced apart, parallel fold lines. As each fold is made, the upper and lower layers of polymer sheet material in the fold are laid on top of the adjoining portion of polymer sheet material. The resulting series of folds resembles a flattened roll of material.

Figure 19:
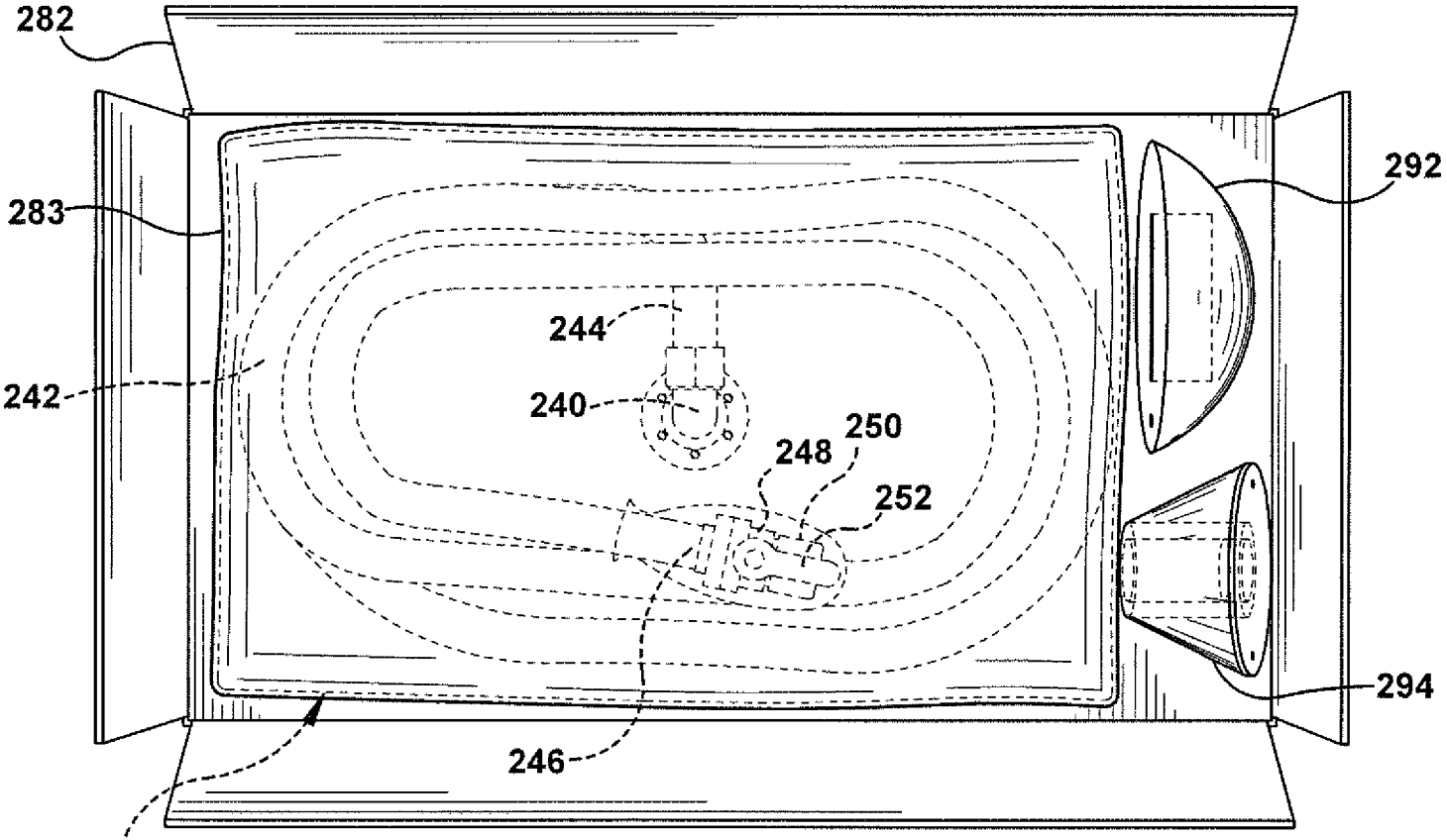
FIG. 19 is a top view of the liner of FIG. 17 in a fully folded condition in a shipping container.

One embodiment of a liner 200 in its fully folded condition is shown in FIG. 19. As can be seen, the fully folded liner 200 is placed in a box or other container 282 for storage and transportation and, potentially, initial insertion into a tank 26. Unlike the container 110 shown in FIG. 4, the container 282 is shaped and dimensioned to receive the hose 242, the valve 248, and the coupling 250, as well as the folded liner 200 and the fitting 240. The valve 248 and the coupling 250 may optionally be wrapped with a relatively soft foam material or other wrapping (not shown) to help cushion the valve and coupling against inadvertent damage during installation, in particular. The container 282 also includes shields 292 and 294 to provide further protection for the liner 200 against being torn or cut by projections inside the tank 26, as will be explained in more detail below. The container 282 may be configured and dimensioned to fit through the manhole 34. Alternatively, the fully folded liner 200 may be placed in a bag, sleeve or cover 283 that is woven or otherwise fabricated of a flexible, yet abrasion-resistant material, such as polypropylene (PP). Such a cover 283 will protect the liner 200 from abrasion damage as the liner is inserted through the manhole. The fully folded liner 200 may be placed in such a cover 283 either before being placed in the container 282 or after being removed from the container 282. Although the liner 200 can potentially be folded into a configuration that can fit through the manhole 34 without contacting the collar 112 or another portion of the tank 26, placing the liner 200 in a flexible protective cover or a container 282 that is shaped and dimensioned to fit through the manhole 34 may more reliably protect the liner.

To install the fully folded liner 200 in a tank 26, the fully folded liner is removed from the container 282 and inserted into the tank through the manhole 34. Once the fully folded liner 200 is in the tank cavity 32, the liner is unfolded manually by an individual (not shown), who enters the tank cavity through the manhole 34. The fully folded liner 200, which is relatively heavy, is first positioned on the lower interior surface 114 of the side wall 30 of the tank 26 such that the liner, when unfolded, will have its first and second ends 214 and 216 positioned adjacent to the end walls 31 of the tank. The liner 200 is then partially unfolded to the condition similar to the condition of the liner 50 shown in FIG. 3. The partially unfolded liner 200 is then further, but not completely, unfolded by unfolding some, but not all, of the folds created along the fold lines that extend lengthwise of the liner. One or more of the folds remain unfolded, similar to what is shown in FIG. 8 for the liner 50.

At this point, the liner 200 is not unfolded further. Instead, the straps 232 and 234 are removed from any remaining folds of the liner in which the straps may be wrapped and are extended toward the manhole 34. If the liner 200 is positioned appropriately and the straps 232 and 234 are appropriately dimensioned, the straps extend through the manhole and the end portions 284 and 286, respectively, of the straps are positioned at the manhole 34 and/or outside of the tank 26. The hose 242 is introduced from outside the tank 26 through the manhole 34, and the first end 244 of the hose is connected to the fitting 240. The external hose 94 is then connected to the coupling 250 attached to the opposite second end 246 of the hose 242. The coupling 250 and its associated valve 248 are maintained at the manhole 34 and/or outside of the tank 26 after being connected to the external hose 94. When the external hose 94 is connected to a source of fluid cargo (not shown) for the tank 26, the valve 248 may be opened by manually operating the handle 252 so that the fluid cargo may fill the liner 200.

As the liner 200 is being filled with a fluid cargo, such as a liquid, the fluid cargo will cause the remaining folds in the liner to unfold. With the end portions 284 and 286 of the straps 232 and 234, respectively, and the coupling 250 and its associated valve 248 located at the manhole 34 and/or outside of the tank 26, the straps and the hose 242 should remain on top of the partially and, ultimately, completely filled liner 200, as partially shown in FIG. 20. The individual (not shown) responsible for filling the liner 200 and the tank 26 may, however, need to monitor the filling process and adjust the positions of the straps 232 and 234 and the hose 242, as required, to ensure that the straps and the hose are not trapped by the filling liner against, for example, the side wall 30 or end walls 31 of the tank. When the liner 200 and, therefore, the tank 26 are filled to a desired volume, the valve 248 may be closed and the external hose 94 may be disconnected from the coupling 250.

Before the manhole lid 36 is closed to permit the tank 26 to be loaded on, for example, the truck 22, a rail car (not shown), or a container ship (not shown), the valve 248 and the coupling 250 and, therefore, the attached second end 246 of the hose 242 are releasably attached to the manhole lid. The releasably attachment may be provided by the attachment apparatus 120 shown in FIGS. 13 and 14 or the attachment apparatus 140 of FIG. 15. Alternatively, the releasable attachment may be provided by a modified embodiment (not shown) of the attachment apparatus 120 comprising only a lid gasket 122 and a single cross strap 124. In such a modified embodiment, the single cross strap 124 would extend diametrically across the circular lid gasket 122 and, therefore, diametrically across the manhole lid 36. The valve 248, the coupling 250, and the second end 246 of the hose 242 would be attached to the single cross strap 124 by a cargo strap, rope, resilient shock cord, bungee cord, or any other engagement element that can engage the single cross strap 124, that can be manually released, and that can support the weight of the valve 248, the coupling 250, and the second end 246 of the hose 242. The length of the cargo strap, rope, resilient shock cord, bungee cord, or other engagement element will determine how closely the valve 248, the coupling 250, and the second end 246 of the hose 242 follow the movement of the manhole lid 36 as it pivots from its closed position to its open position. The straps 232 and 234 may be wrapped or tied around the single cross strap.

With the valve 248, the coupling 250, and the second end 246 of the hose 242 releasably attached to the manhole lid 36 via the attachment apparatus, together with the end portions 284 and 286 of the straps 232 and 234, the coupling, the second end of the hose, and the ends of the straps will all be conveniently presented to the individual who opens the manhole lid 36 at the destination for the tank 26. The individual may then quickly and conveniently release the valve 248, the coupling 250, and the second end 246 of the hose 242, together with the end portions 284 and 286 of the straps 232 and 234, and connect the coupling 250 to an external hose 94 to permit the liner 200 and, therefore, the tank 26 to be unloaded of its cargo. As the unloading of the fluid cargo from the liner 200 is nearing a conclusion, it may be increasingly difficult for the fluid cargo to reach the fitting 250. The straps 232 and 234 may then be used to pull upward on the first and second ends 214 and 216 of the liner 200 to cause the fluid cargo to flow toward the fitting 240 for more complete emptying of the fluid cargo from the liner and the tank 26. Moreover, when the fluid cargo is complete emptied from the liner 200 or emptied to the extent practical, the straps 232 and 234 may be used to help remove the empty or nearly empty liner from the tank cavity 32.

Figure 25:
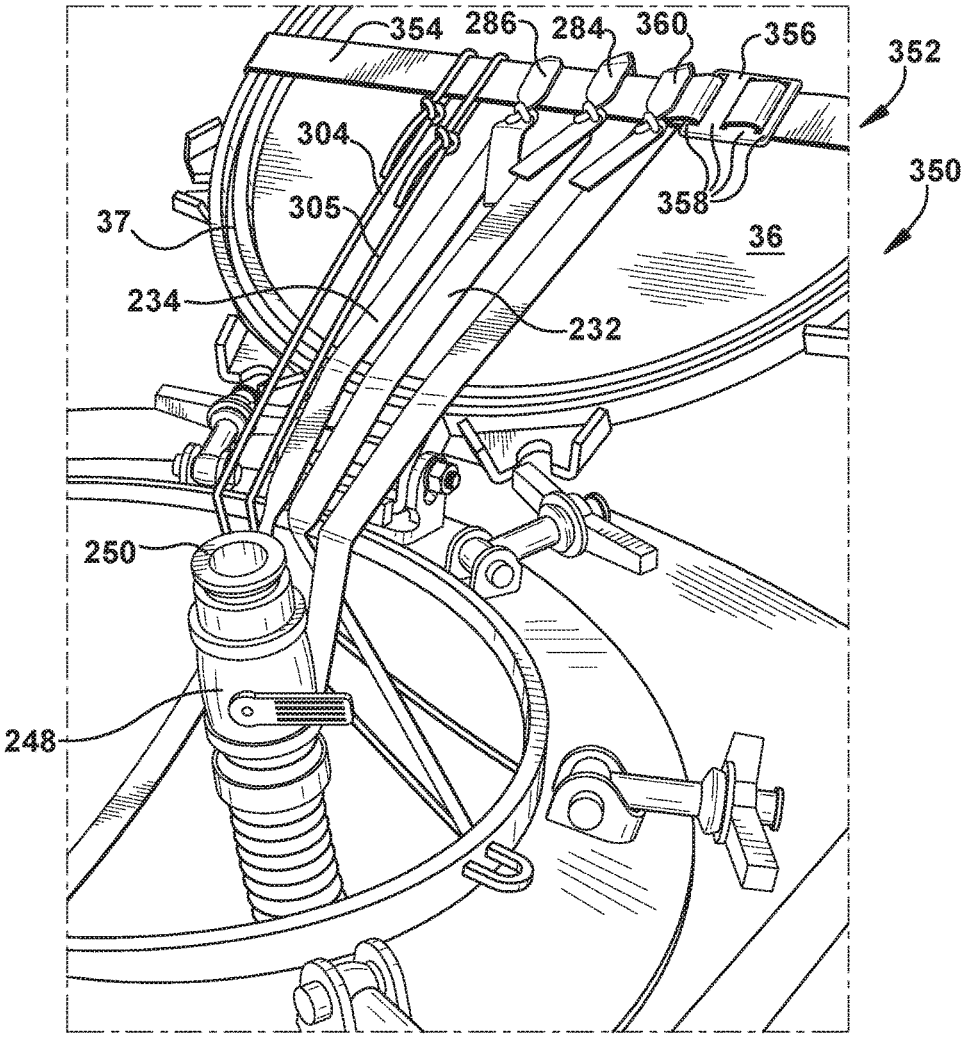
FIG. 25 is a perspective view of yet another alternative apparatus for releasably attaching a hose and valve to the manhole lid of the shipping tank of FIG. 1.
Figure 26:
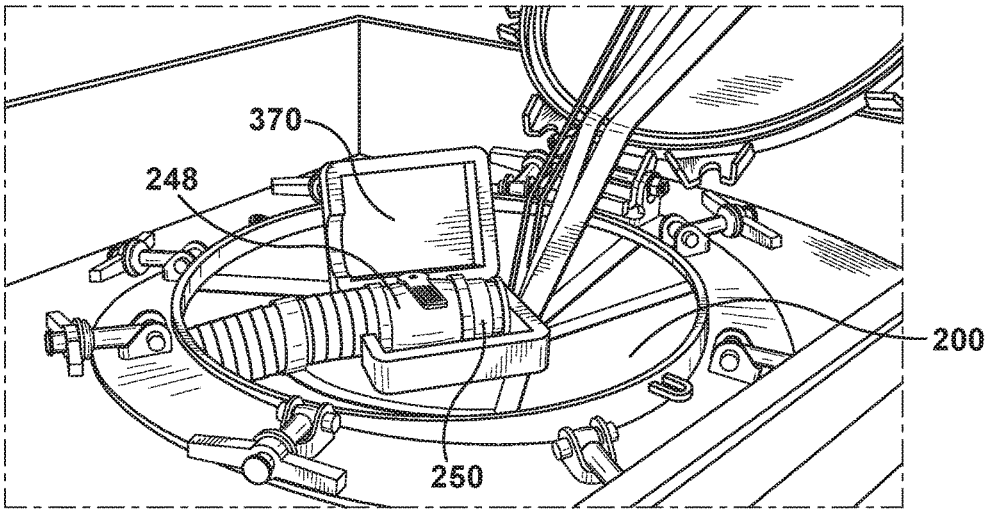
FIG. 26 is a second perspective view of the apparatus of FIG. 25.

Yet another releasable attachment apparatus 350 is shown in FIGS. 25 and 26. The attachment apparatus 350 comprises a single cross strap, in the form of a cargo strap 352. As shown, the cargo strap 352 includes a length of flexible material 354, such as a woven nylon strap, and a buckle or slotted clip 356. The ends of the length of flexible material 354 are passed through slots and around crossbars 358 in the clip 356 to secure the ends of the flexible material to one another in a loop. One of the ends of the length of flexible material 354 may be sewn in a loop around a crossbar 358 in the clip 356 so as to be permanently secured to the clip. The other, opposite end of the length of flexible material 354 is wound around one or more crossbars 358 of the clip 356 so that the length of flexible material may be tightened or loosed. In use, such a cargo strap 352 extends diametrically across the manhole lid 36 in a loop that passes over and engages the lip 37 adjacent the outer perimeter or circumference of the manhole lid and that passes around the exterior surface of the manhole lid. The ends of the length of flexible material 354 are pulled tight in the clip 356 to secure the cargo strap 352 to the manhole lid 36. After the manhole lid 36 is closed, the cargo strap 352 will be trapped and held between the manhole lid and the collar 112 surrounding the manhole 34. The valve 248, the coupling 250, and the second end 246 of the hose 242 are attached to the cross strap or cargo strap 352 by a second cargo strap, a rope, a resilient shock cord, a bungee cord, or any other engagement element 360 that can engage the cross strap 352, that can be manually released, and that can support the weight of the valve 248, the coupling 250, and the second end 246 of the hose 242. The end portions 284 and 286 of the straps 232 and 234, respectively, may be attached to the cross strap or cargo strap 352 by, for example, hook-and-loop fasteners or tying the end portions to themselves in a knot. The length of the second cargo strap, the rope, the resilient shock cord, the bungee cord, or other engagement element will determine how closely the valve 248, the coupling 250, and the second end 246 of the hose 242 follow the movement of the manhole lid 36 as it pivots from its closed position to its open position.

The length of the second cargo strap, the rope, the resilient shock cord, the bungee cord, or other engagement element 360 should not allow the valve 248, the coupling 250, and the second end 246 of the hose 242 to hang or depend so far from the manhole lid 36 in its open position that the valve, the coupling, and the second end of the hose cannot be conveniently reachable. As shown in FIG. 25, when the valve 248, the coupling 250, and the second end 246 of the hose 242 are engaged by the engagement element 360 and the manhole lid 36 is in its open position, the coupling 250, in particular, is positioned at approximately the same location as the collar 112 that surrounds the manhole 34. Although the positions of the valve 248, the coupling 250, and the second end 246 of the hose 242 in FIG. 25 are somewhat less convenient than, for example, the positions of the valve 88, the coupling 90, and the second end 86 of the hose 82 in FIG. 14, the additional spacing between the manhole lid 36 and the valve 248, the coupling 250, and the second end 246 of the hose 242 in FIG. 25 provides some potential advantages.

In particular, when the tank 26 with an installed liner 50 or 200 filled with liquid is being transported on the truck 22, a rail car (not shown), or a container ship (not shown), the tank, the liner, and the liquid in the liner will be subjected to forces or loads associated with movements of the truck, rail car, or ship resulting from, for example, stopping, starting, ocean waves, irregularities in a roadway, and gaps between adjacent rails in a railway track. Such forces or loads may be substantial shock loads, such as may result from stopping or starting a long freight train, or may be repetitive smaller loads, such as may result from wave action. In any event, such forces or loads may cause movement of the liquid in the liner 50 or 200 and, potentially, movement of both the liquid being transported and the liner relative to the tank 26. Movements of the liner 50 or 200 relative to the tank 26 may cause damage to the hose 82 or 242, the fitting 80 or 240, the valve 88 or 248, the coupling 90 or 250, and/or the liner itself. The possibility of such damage can be reduced by increasing the length of the hose 82 or 242 or by using a relatively long engagement element, such as engagement element 360 or by using an elastic engagement element, such as a shock cord or bungee cord, so as to accommodate movement between the liner 50 or 200 and the tank 26. When using a relatively long engagement element, such as engagement element 360, it may be desirable to provide the valve 88 or 248 and the coupling 90 or 250 with a protective cover 370, such as is shown in FIG. 26. The protective cover 370 may have any configuration and construction that will protect the valve 88 or 248 and the coupling 90 or 250 from damage during transportation. As demonstrated by FIG. 26, when the liner 200 is filled with liquid, the valve 248 and the coupling 250 rest on top of the filled liner 200 and may slide over the Liner into contact with the interior of the tank 26.

As indicated previously, the liner 200 and the liner 50 must be protected against damage during installation and use. A tank 26 may include internal structures that are intended to facilitate certain uses of the tank, but that present the possibility of damage when a liner, such as the liner 50 or the liner 200 is used in the tank. For example, FIG. 20 illustrates a tank 26 that includes a guider pin 288 and a bottom valve 290. The guider pin 288 is intended to help secure a tube (not shown) that is sometimes used for loading the tank 26. The bottom valve 290 is intended to drain the tank 26 when the tank is used without a liner. As can be seen in FIG. 20, both the guider pin 288 and the bottom valve 290 project from the side wall 30 or an end wall 31 of the tank 26 into the tank cavity 32. The guider pin 288 and the bottom valve 290 thus may abrade or puncture the liner 200, which is shown installed and partially filled in the tank 26 in FIG. 20.

Figure 21:
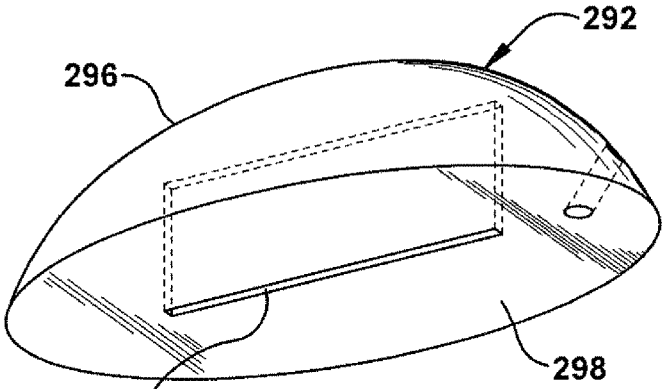
FIG. 21 is a perspective view of a device to protect the liner of FIG. 17 from being damaged by the guider pin of FIG. 20.
Figure 22:
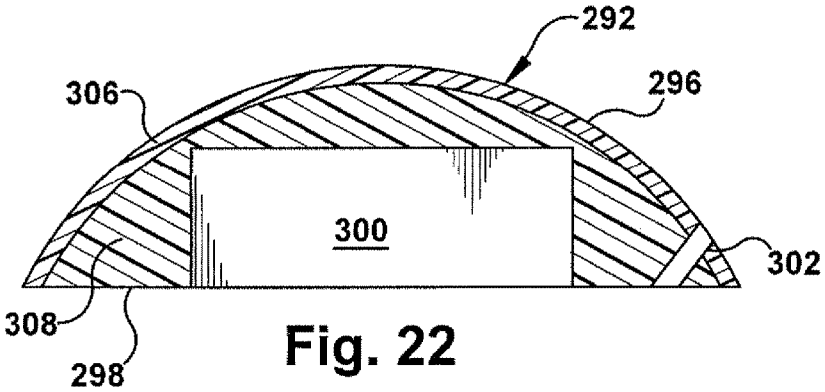
FIG. 22 is a sectional view of the device of FIG. 21.

To protect the liner 200 against abrasion, puncture, or other damage by the guider pin 288 and bottom valve 290, a guider pin shield 292 is place over the guider pin and a bottom valve shield 294 is placed over the bottom valve. As shown in FIGS. 21 and 22, the guider pin shield 292 has an overall shape similar to one-half of an ellipsoid or ovoid. The guider pin shield 292 thus has a curved upper surface 296 and a flat lower surface 298. Extending upward from the flat lower surface 298 in the center of the bottom surface is a slot 300. The slot 300 is configured and dimensioned so as to receive the guider pin 288, which has an upwardly angled shape, and also permit the lower surface 298 to lie against the side wall 30 of the tank 26. At one end of the guider pin shield 292, a small passageway 302 extends between the upper surface 296 and the lower surface 298. The passageway 302 receives a tether or cord 304, as shown in FIG. 20, which is used to remove the guider pin shield 292 from the tank 26 when the liner 200 is removed from the tank. The tether or cord 304 may be attached to the adjacent strap 234 or may extend to manhole lid 36.

The guider pin shield 292 is formed of a material or combination of materials that provide the guider pin shield with two sections or layers 306 and 308. The layer 306 is substantially coextensive with the upper surface 296 of the guider pin shield 292. The layer 306 is relatively stiff and has a relatively high density. The layer 308 extends across the lower surface 298 of the guider pin shield 292. The layer 308 is relatively soft, has a relatively low density, and comprises the majority of the interior of the guide pin shield. The layer 308 thus has an overall shape similar to one-half of an ellipsoid or ovoid. The layer 306 is effectively a shell over the layer 308. The material of which the layer 308 is made tends to cause the layer 308 to grip the guider pin 288 when it is inserted into the slot 300 in the guider pin shield 292.

Figure 23:
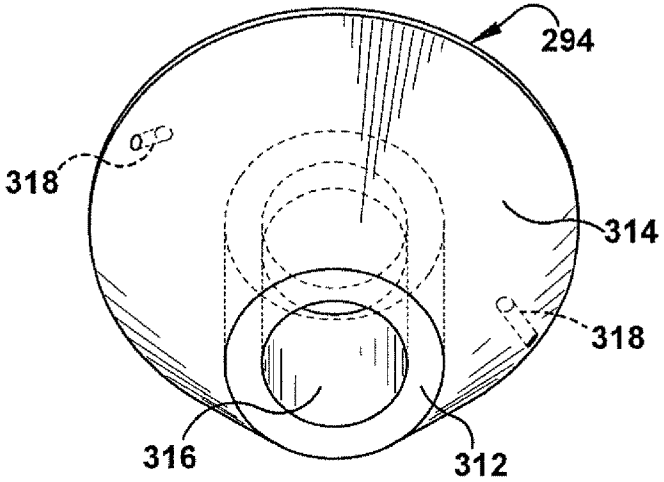
FIG. 23 is a perspective view of a device to protect the liner of FIG. 17 from being damaged by the bottom valve of FIG. 20.
Figure 24:
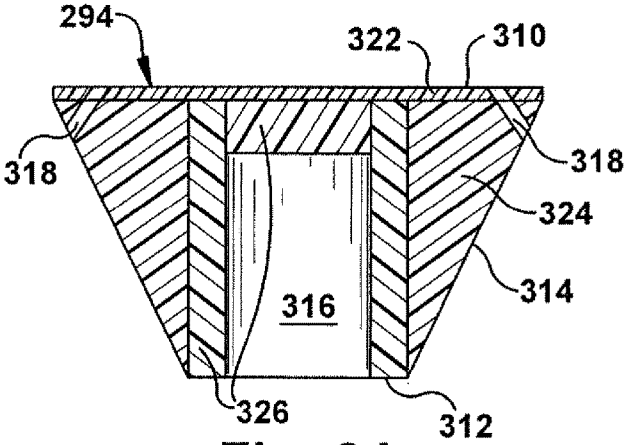
FIG. 24 is a sectional view of the device of FIG. 23.

As shown in FIGS. 23 and 24, the bottom valve shield 294 has an overall shape similar to a frustum of a cone. The bottom valve shield 294 thus has a flat upper surface 310, a flat lower surface 312, and a frustoconical side surface 314 that extends between the flat upper surface and the flat lower surface. Extending upward from the flat lower surface 312 in the center of the bottom surface is a cylindrical hole 316. The cylindrical hole 316 is configured and dimensioned so as to receive the bottom valve 290, which has a generally cylindrical outer shape, and also permit the lower surface 312 to lie against a circular flange 320 located at the intersection of the side wall 30 and an end wall 31 of the tank 26. At each of two diametrically opposed locations on the bottom valve shield 294, a small passageway 318 extends between the upper surface 310 and the side surface 314. The passageways 318 receive the tether or cord 304, as shown in FIG. 20, which is used to remove the bottom valve shield 294 from the tank 26 when the liner 200 is removed from the tank. Alternatively, the passageways 318 may receive a separate tether or cord 305, which is used to remove the bottom valve shield 294 from the tank 26 when the liner 200 is removed from the tank.

The bottom valve shield 294 is formed of a material or combination of materials that provide the guider pin shield with three sections or layers 322, 324, and 326. The layer 322 is substantially coextensive with the upper surface 310 of the bottom valve shield 294. The layer 322 is relatively stiff and has a relatively high density. The layer 324 is substantially coextensive with the side surface 314 of the bottom valve shield 294. The layer 324 is relatively stiff and has a relatively high density. The layer 326 extends across the lower surface 312 of the bottom valve shield 294 and also extends around and defines the hole 316 in center of the interior of the bottom valve shield. The layer 326 thus has an overall shape similar to a cup. The layer 326 is relatively soft, has a relatively low density, and comprises a major portion of the interior of the bottom valve shield 294. The layers 322 and 324 are effectively a shell over the layer 326. The layer 326 may be formed in one piece or, as shown in FIG. 24, in multiple discrete pieces. The material of which the layer 326 is made tends to cause the layer 326 to grip the bottom valve 290 when it is inserted into the hole 316 in the bottom valve shield 294.

Figure 27:
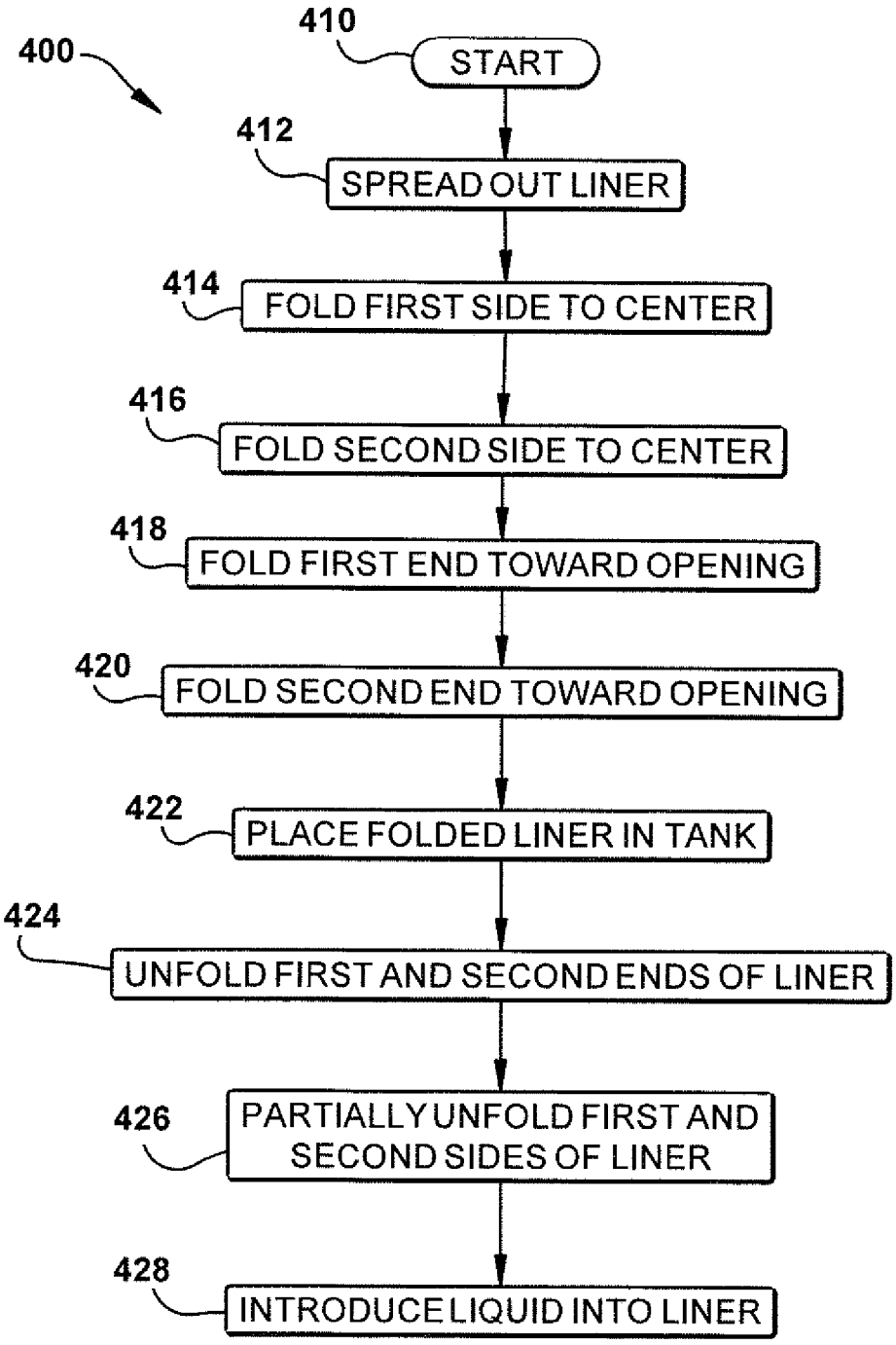
FIG. 27 is a flow chart showing steps in a method for installing a flexible liner in a shipping tank.

FIG. 27 is a flow chart detailing a method of installing a flexible liner in a tank for receiving liquids. The tank may be a tank 26 shown in FIG. 1, which includes a tank body with a tank wall, such as the side and end walls 30 and 31 of FIG. 1, defining an enclosed tank cavity, such as the tank cavity 32 in FIG. 1. A manhole, such as the manhole 34, is formed in the tank wall to permit a person to enter the tank cavity. The tank body also includes a manhole lid, such as the manhole lid 36 of FIG. 1, attached to the tank wall and movable from an open position in which the manhole is open to a closed position closing the manhole. The liner includes a flexible liner wall, such as the side wall 52 of liner 50 or the side wall 212 of the outer liner 202, which defines an enclosed liner cavity, such as the liner cavity 62 shown in FIG. 10 or the inner liner cavity 272 of the inner liner 204 shown in FIG. 20. An opening, such as the access hole 78 shown in FIG. 2 or the access hole 238 shown in FIG. 17, is formed in the liner wall to permit liquid to be introduced into the liner cavity.

The method 400 starts at block 410. The method 400 proceeds to step 412, in which the liner is spread out the liner so that opposite surfaces of the liner wail are touching each other and the liner is flattened with a generally rectangular shape, in a manner such as shown for the liner 50 in FIG. 2. The generally rectangular shape of the flattened liner includes a first side and an opposed second side, such as the first and second sides 96 and 98 in FIG. 2, and a first end and an opposed second end, such as the first and second ends 54 and 56 in FIG. 2. The opening, such as the access hole 78 of FIG. 2, in the liner is positioned centrally between the first and second sides and spaced longitudinally away from the first and second ends.

At step 414, the first side of the flattened liner is folded toward the center of the liner while leaving the opening exposed. This step is illustrated, for example, in FIGS. 2 and 7, in which the side 96 of the liner 50 is folded along fold lines 102 toward the central portion 100 of the liner. The second side of the flattened liner is folded, at step 416, toward the center of the liner while leaving the opening exposed. This step is also illustrated, for example, in FIGS. 2 and 7, in which the side 98 of the liner 50 is folded along fold lines 104 toward the central portion 100 of the liner.

The method 400 proceeds to step 418, in which a first end of the flattened liner is folded toward the opening after folding the first and second sides of the flattened liner toward the center of the liner. The opening is left exposed after folding the first end of the flattened liner toward the opening. Step 418 is illustrated, for example, in FIG. 3, in which the first end 54 of the liner 50 is folded along fold lines 106 toward the centerline or midpoint 76 of the length of the liner. The second end of the flattened liner is folded, at step 420, toward the opening after folding the first and second sides of the flattened liner toward the center of the liner. This step 420 is also illustrated, for example, in FIG. 3, in which the second end 56 of the liner 50 is folded along fold lines 108 toward the midpoint 76 of the liner.

The method 400 next proceeds to step 422, in which the liner is placed in the tank cavity after folding the first and second sides of the flattened liner toward the center of the liner and after folding the first and second ends of the flattened liner toward the opening. The opening is presented toward the manhole when the liner is placed in the tank cavity. Step 422 is illustrated, for example, on the left side of FIG. 6, in which the liner 50 is placed in the tank cavity 32. After step 422, the next step 424 of the method 400 is unfolding the first and second ends of the liner after placing the liner in the tank cavity. Step 424 is illustrated, for example, on the right side of FIG. 6, in which the first and second ends 54 and 56 are unfolded after the liner 50 is place in the tank cavity 32.

In step 426 of the method 400, the first and second sides of the liner are partially unfolded after unfolding the first and second ends of the liner. Step 426 is illustrated, for example, on the right side of FIG. 6 and in FIG. 8, in which the sides 96 and 98 of the liner 50 are partially unfolded, leaving a few folds 103 and 105 after the liner 50 is place in the tank cavity 32. Lastly, the method 400 proceeds to step 428, in which liquid is introduced into the liner cavity through the opening to finish unfolding of the first and second sides of the liner.

Figure 28:
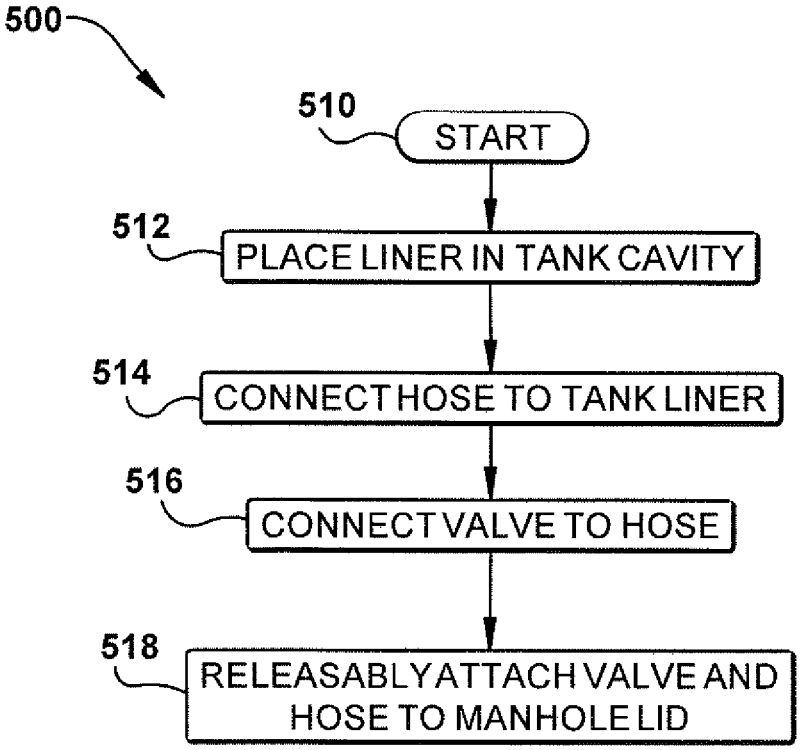
FIG. 28 is a flow chart showing steps in another method for installing a flexible liner in a shipping tank.

FIG. 28 is a flow chart detailing a method 500 of installing a flexible liner in a tank for receiving liquids. The tank may be a tank 26 shown in FIG. 1, which includes a tank body with a tank wall, such as the side and end walls 30 and 31 of FIG. 1, defining an enclosed tank cavity, such as the tank cavity 32 in FIG. 1. A manhole, such as the manhole 34, is formed in the tank wall to permit a person to enter the tank cavity. The tank body also includes a manhole lid, such as the manhole lid 36 of FIG. 1, attached to the tank wall and movable from an open position in which the manhole is open to a closed position closing the manhole. The liner includes a flexible liner wall, such as the side wall 52 of liner 50 or the side wall 212 of the outer liner 202, which defines an enclosed liner cavity, such as the liner cavity 62 shown in FIG. 10 or the inner liner cavity 272 of the inner liner 204 shown in FIG. 20. An opening, such as the access hole 78 shown in FIG. 2 or the access hole 238 shown in FIG. 17, is formed in the liner wall to permit liquid to be introduced into the liner cavity.

The method 500 starts at block 510. The method 500 proceeds to step 512, in which the liner is placed in the tank cavity. The opening in the liner wall is presented toward the manhole when the liner is placed in the tank cavity. Step 512 is illustrated, for example, on the left and right sides of FIG. 6, in which the liner 50 is placed in the tank cavity 32. At step 514, a hose is connected to the liner so that liquid can be introduced into the liner cavity through the hose and the opening in the liner. The hose has a first end and a second end. The first end of the hose is attached to the liner. Step 514 is illustrated, for example, in FIGS. 9 and 10, in which the first end 84 of the hose 82 is connected to the fitting 80 secured to the liner 50. At step 516, a valve is attached to the second end of the hose. Step 516 is also illustrated, for example, in FIGS. 9 and 10, in which a valve 88 is attached to the second end 86 of the hose 82.

In step 518 of the method 500, the valve and the second end of the hose are releasably attached to the manhole lid. Specifically, the valve and second end of the hose are attached to the manhole lid such that the valve and the second end of the hose remain attached to the manhole lid when the manhole lid is in its closed position. The valve and the second end of the hose are releasable from the manhole lid when the manhole lid is in its open position. Step 518 is illustrated, for example, in FIG. 14, in which the valve 88 and the second end 86 of the hose 82 are releasably attached to the manhole lid 36 and move with the manhole lid.

Although the installation of a liner 50 or 200 in a tank 26 may be followed immediately by filling the liner and the tank, the liner may be installed at a first location, and the liner and the tank may then be transported to a second location at which the liner and the tank are filled. In such a situation, steps 412 through 426 of the method 400 would be performed at the first location, while step 428 of the method 400 would be performed at the second location.

The liner 50 and the liner 200 are dimensioned to provide a usable internal volume within the liner cavities 62 and 272, respectively, of about 24,000 liters. The liners 50 and 200 could, however, be dimensioned to provide greater or lesser usable internal volumes. With length of about 730 centimeters (cm) and a flattened width of about 388 cm for the liner 50 and the liner 200, the fold lines 102 and 104 for the liner 50 and the corresponding fold lines (not shown) for the liner 200 may be spaced apart from one another by a distance of from about 30 cm to about 50 cm. The foregoing spacing of the fold lines is selected to facilitate passing the fully folded liner 50 or 200 through the manhole 34. The fold lines 106 and 108 for the liner 50 and the corresponding fold lines (not shown) for the liner 200 may be spaced apart from one another by a distance of from about 100 cm to about 110 cm.

While the liner 50 comprises a single liner and the liner 200 comprises two liners, namely, an outer liner 202 and an inner liner 204, either of the liners 50 or 200 may be fabricated of more than two liners. Such liners may be fabricated of different materials that have different desirable properties. For example, an outer liner may be fabricated of a material that is particularly durable and resistant to abrasion and punctures. A first inner liner may be fabricated of a material that is less resistant to abrasion and punctures, but is more resistant to rupture due to high internal pressure. A second inner liner may be fabricated of a material that is less resistant to abrasion and punctures, but is more effective at blocking oxygen from migrating through the liner.

Also, while the liner 50 and the outer and inner liners 202 and 204 of liner 200 have been illustrated as being formed with side wall 52, 212, and 262 shaped like right circular cylinders that can be flattened into rectangles, the liners can have side walls with different shapes. The shapes of the side walls 52, 212, and 262 can varied so as to match the shape of the side wall 30 of the tank 26 as closely as possible, consistent with the construction of the liner 50 and outer and inner liners 202 and 204. In the same manner, the shapes of the primary seams 58 and 60 and the first and second ends 54 and 56 of the side wall 52 can varied as desired either to match the shape of end walls 31 of the tank 26 or to facilitate installation of removal of the liner 50 in the tank 26. Similarly, the shapes of the primary seams 218 and 220 and the first and second ends 214 and 216 of the side wall 212, as well as the primary seams 268 and 270 and the first and second ends 264 and 266 of the side wall 262 can varied as desired either to match the shape of end walls 31 of the tank 26 or to facilitate installation of removal of the liner 200 in the tank 26.

To facilitate attaching the end of a hose, a valve, and/or a coupling to an otherwise standard manhole lid, several different embodiments of an attachment apparatus are described above. Each embodiment, such the attachment apparatus 120 shown in FIGS. 13 and 14, the attachment apparatus 140 shown in FIG. 15, and the attachment apparatus shown in FIGS. 25 and 26, includes (a) a lid-engaging structure, which is body of flexible material, such as the lid gasket 122, the sleeve 148, and the cargo strap 352, for engaging a manhole lid 36 and (b) attachment structure for coupling the end of a hose, a valve, and/or a coupling to the body of flexible material. In the attachment apparatus 120, the attachment structure includes the cross straps 124, the attachment straps 126, and the engagement loops 130. In the attachment apparatus 140, the attachment structure includes the engagement loops 152. In the previously described modified embodiment of the attachment apparatus 120, which only includes the lid gasket 122 and a single cross strap 124, the attachment structure includes the single cross strap 124 and the cargo strap, rope, resilient shock cord, bungee cord, or other engagement element that can engage the single cross strap 124. In the attachment apparatus 350, the attachment structure includes the second cargo strap, the rope, the resilient shock cord, the bungee cord, or other engagement element 360 that can engage the cargo strap 352.

While each of the foregoing embodiments of an attachment apparatus can be conveniently attached to and then removed from a standard manhole lid 36, it would also be possible to provide a manhole lid with an attachment apparatus that includes a permanently connected lid-engaging structure with a permanently connected portion of an attachment structure. Such an attachment apparatus may include, for example, a metal cross strap or bracket, metal ring, or other device that is welded or riveted to the manhole lid. The lid-engaging structure would include the ends of the cross strap, bracket or ring that are fixed to the manhole lid and the portion of the attachment structure would include the portion of the cross strap, bracket or ring intermediate its ends to which an end of a hose, a valve, and/or a coupling may be attached using a cargo strap, rope, resilient shock cord, bungee cord, or other engagement element comprising the remainder of the attachment structure.

From the above description of the invention, those skilled in the art will perceive improvements, changes and modifications. Such improvements, changes, and/or modifications within the skill of the art are intended to be covered by the appended claims.

Having described the invention, the following is claimed:

1. A tank assembly for receiving liquids comprising:

a tank body including a tank wall defining an enclosed tank cavity, a manhole being formed in the tank wall to permit a person to enter the tank cavity, the tank body also including a manhole lid attached to the tank wall, the manhole lid being movable from a closed position covering the manhole to an open position uncovering the manhole while remaining attached to the tank wall;

a liner in the tank cavity including a flexible liner wall defining an enclosed liner cavity, an opening being formed in the liner wall to permit liquid to be introduced into the liner cavity, the liner also including a fitting extending through the opening, the fitting being secured to the liner wall adjacent the opening;

a hose having a first end and a second end, the first end of the hose being attached to the fitting for conducting liquid to the liner cavity;

a valve connected to the second end of the hose, the valve and the second end of the hose being attachable to the manhole lid such that the valve and the second end of the hose remain attached to the manhole lid when the manhole lid is in its closed position without providing a flow path for liquid to flow through the manhole lid, the valve and the second end of the hose being releasable from the manhole lid when the manhole lid is in its open position; and an apparatus for attaching the hose and the valve to the manhole lid without providing a flow path for liquid to flow through the manhole lid, the apparatus including lid-engaging structure and attachment structure, the lid-engaging structure being engageable with and directly attachable to the manhole lid such that the lid-engaging structure remains directly attached to the manhole lid when the manhole lid is in its closed position and when the manhole lid is in its open position, the lid-engaging structure when directly attached to the manhole lid moving with the manhole lid as the manhole lid moves from its closed position to its open position, the attachment structure being directly attachable to the lid-engaging structure such that at least a portion of the attachment structure moves with the lid-engaging structure, the attachment structure being configured to releasably couple at least one of the hose and the valve to the lid-engaging structure such that the hose and the valve are releasably attached to the manhole lid, the attachment structure including an engagement element configured to contact the at least one of the hose and the valve and to releasably couple the at least one of the hose and the valve to the lid engaging structure.

2. A tank assembly according to claim 1 wherein the manhole lid is attached to the tank wall with a hinge, the manhole lid moving from its closed position to its open position by pivoting about the hinge.

3. A tank assembly according to claim 1 wherein the liner comprises an outer liner and an inner liner, the outer liner including a flexible outer liner wall defining an enclosed outer liner cavity, the inner liner including a flexible inner liner wall defining an enclosed inner liner cavity, the inner liner being received in the outer liner cavity.

4. A tank assembly according to claim 3 wherein the outer liner includes an outer opening formed in the outer liner wall, the inner liner including an inner opening formed in the inner liner wall, the outer liner and the inner liner being connected to each other adjacent the outer opening and the inner opening so that the outer opening is aligned with the inner opening to permit liquid to be introduced into the inner liner cavity through the aligned outer and inner openings, the fitting extending through the outer opening and the inner opening, the fitting being secured to the outer liner wall adjacent the outer opening and being secured to the inner liner wall adjacent the inner opening.

5. A tank assembly according to claim 1 further comprising a shield for protecting the liner against being damaged by a structure projecting from the tank body into the tank cavity, the shield being coupled to the liner such that the liner and the shield may be removed from the tank cavity together.

6. A tank assembly according to claim 1 wherein the liner also includes a strap connected to the liner wall at a location spaced from the opening, an end portion of the strap spaced from the liner wall being attachable to the manhole lid such that the end portion of the strap remains attached to the manhole lid when the manhole lid is in its closed position, the end portion of the strap when attached to the manhole lid moving with the manhole lid as the manhole lid moves from the closed position to the open position, the end portion of the strap being releasable from the manhole lid when the manhole lid is in its open position.

7. A tank assembly according to claim 1 wherein the valve and the second end of the hose when attached to the manhole lid move with the manhole lid as the manhole lid moves from the closed position to the open position.

8. A tank assembly for receiving liquids comprising:

a tank body including a tank wall defining an enclosed tank cavity, a manhole being formed in the tank wall to permit a person to enter the tank cavity, the tank body also including a manhole lid attached to the tank wall, the manhole lid being movable from a closed position covering the manhole to an open position uncovering the manhole while remaining attached to the tank wall;

a liner in the tank cavity including a flexible liner wall defining an enclosed liner cavity, an opening being formed in the liner wall to permit liquid to be introduced into the liner cavity, the liner also including a fitting extending through the opening, the fitting being secured to the liner wall adjacent the opening;

a hose having a first end and a second end, the first end of the hose being attached to the fitting for conducting liquid to the liner cavity;

a valve connected to the second end of the hose, the valve and the second end of the hose being attachable to the manhole lid such that the valve and the second end of the hose remain attached to the manhole lid when the manhole lid is in its closed position without providing a flow path for liquid to flow through the manhole lid, the valve and the second end of the hose being releasable from the manhole lid when the manhole lid is in its open position; and an apparatus for attaching the hose and the valve to the manhole lid without providing a flow path for liquid to flow through the manhole lid, the apparatus including lid-engaging structure and attachment structure, the lid-engaging structure being engageable with and directly attachable to the manhole lid such that the lid-engaging structure remains directly attached to the manhole lid when the manhole lid is in its closed position and when the manhole lid is in its open position, the lid-engaging structure when directly attached to the manhole lid moving with the manhole lid as the manhole lid moves from its closed position to its open position, the attachment structure being directly attachable to the lid-engaging structure such that at least a portion of the attachment structure moves with the lid-engaging structure, the attachment structure being configured to releasably couple at least one of the hose and the valve to the lid-engaging structure such that the hose and the valve are releasably attached to the manhole lid, the lid-engaging structure including a body formed of flexible material, the body including a gasket portion engageable with and directly attachable to a lip formed on the manhole lid adjacent an outer perimeter of the manhole lid, the gasket portion remaining directly attached to the manhole lid when the manhole lid is in its closed position and when the manhole lid is in its open position, the lid-engaging structure when directly attached to the manhole lid moving with the manhole lid as the manhole lid moves from its closed position to its open position, the body being directly attached to the manhole lid when the gasket portion engages the lip, the attachment structure including a strap secured to the body of flexible material and an engagement element configured to releasably couple the at least one of the hose and the valve to the strap.

9. A tank assembly according to claim 8 wherein the gasket portion has an annular shape and the strap is secured at opposite ends to the gasket portion so as to extend across the annular shape of the gasket portion.

10. A tank assembly for receiving liquids comprising:

a tank body including a tank wall defining an enclosed tank cavity, a manhole being formed in the tank wall to permit a person to enter the tank cavity, the tank body also including a manhole lid attached to the tank wall, the manhole lid being movable from closed position covering the manhole to an open position uncovering the manhole while remaining attached to the tank wall;

a liner in the tank cavity including a flexible liner wall defining an enclosed liner cavity, an opening being formed in the liner wall to permit liquid to be introduced into the liner cavity, the liner also including a strap connected to the liner wall at a location spaced from the opening, an end portion of the strap spaced from the liner wall being attachable to the manhole lid such that the end portion of the strap remains attached to the manhole lid when the manhole lid is in its closed position and when the manhole lid is in its open position, the end portion of the strap when attached to the manhole lid moving with the manhole lid as the manhole lid moves from the closed position to the open position, the end portion of the strap being releasable from the manhole lid when the manhole lid is in its open position; and an apparatus for attaching the end portion of the strap to the manhole lid, the apparatus including lid-engaging structure and attachment structure, the lid-engaging structure being engageable with and directly attachable to the manhole lid such that the lid-engaging structure remains directly attached to the manhole lid when the manhole lid is in its closed position and when the manhole lid is in its open position, the lid-engaging structure when directly attached to the manhole lid moving with the manhole lid as the manhole lid moves from its closed position to its open position, the attachment structure being directly attachable to the lid-engaging structure such that at least a portion of the attachment structure moves with the lid-engaging structure, the attachment structure being configured to releasably couple the end portion of the strap to the lid-engaging structure such that the end portion of the strap is releasably attached to the manhole lid, the lid-engaging structure including a body formed of flexible material, the body including a gasket portion engageable with and directly attachable to a lip formed on the manhole lid adjacent an outer perimeter of the manhole lid, the gasket portion remaining directly attached to the manhole lid when the manhole lid is in its closed position and when the manhole lid is in its open position, the lid-engaging structure when directly attached to the manhole lid moving with the manhole lid as the manhole lid moves from its closed position to its open position, the body being directly attached to the manhole lid when the gasket portion engages the lip, the attachment structure including an attachment strap secured to the body of flexible material and an engagement element configured to releasably couple the end portion of the strap included in the liner to the attachment strap.

11. A tank assembly according to claim 10 wherein the manhole lid is attached to the tank wall with a hinge, the manhole lid moving from its closed position to its open position by pivoting about the hinge.

12. A tank assembly according to claim 10 wherein an intermediate portion of the strap spaced from the end portion of the strap is slidably connected to the liner wall.

13. A tank assembly according to claim 10 wherein an intermediate portion of the strap spaced from the end portion of the strap is immovably connected to the liner wall.

14. A tank assembly according to claim 10 further comprising a sleeve covering the strap between the end portion of the strap and an intermediate portion of the strap connected to the liner wall.

15. A tank assembly according to claim 10 further comprising a shield for protecting the liner against being damage by a structure projecting from the tank body into the tank cavity, the shield being coupled to the liner such that the liner and the shield may be removed from the tank cavity together.

16. A tank assembly according to claim 10 wherein the gasket portion has an annular shape and the attachment strap is secured at opposite ends to the gasket portion so as to extend across the annular shape of the gasket portion.

17. A tank assembly according to claim 10 wherein the engagement element is configured to contact the end portion of the strap included in the liner and to releasably couple the end portion of the strap included in the liner to the lid engaging structure.

* * * * *